US006521005B1

(12) United States Patent
Vincent

(10) Patent No.: US 6,521,005 B1
(45) Date of Patent: Feb. 18, 2003

(54) SURFACE CONDITIONING ARTICLES AND METHOD OF MAKING SAME

(75) Inventor: Bernard Vincent, Rueil Malmaison (FR)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/193,760

(22) Filed: Jul. 11, 2002

Related U.S. Application Data

(63) Continuation of application No. 09/906,498, filed on Jul. 16, 2001, now abandoned, which is a continuation of application No. 09/068,839, filed as application No. PCT/US96/19188 on Nov. 27, 1996, now abandoned.

(51) Int. Cl.[7] ..... B24D 3/02

(52) U.S. Cl. ..... 51/298; 51/295; 51/294; 51/299; 51/307; 51/309

(58) Field of Search ..... 51/294, 295, 298, 51/299, 307, 309; 428/378, 380, 383, 384, 394

(56) References Cited

U.S. PATENT DOCUMENTS

| | | | |
|---|---|---|---|
| 2,958,583 | A | 11/1960 | Hervert et al. |
| 3,806,956 | A | 4/1974 | Supkis et al. |
| 4,084,941 | A | 4/1978 | Cox et al. |
| 4,227,350 | A | 10/1980 | Fitzer |
| 4,587,291 | A | 5/1986 | Gardziella et al. |
| 4,652,275 | A | 3/1987 | Bloecher et al. |
| 4,799,939 | A | 1/1989 | Bloecher et al. |
| 5,306,319 | A | 4/1994 | Krishnan et al. |
| 5,591,239 | A | 1/1997 | Larson et al. |

FOREIGN PATENT DOCUMENTS

| | | |
|---|---|---|
| DE | 41 38 717 A1 | 5/1993 |

OTHER PUBLICATIONS

Abstract of SU 1 134 579 A; Jan. 15, 1985; Derwent Publications, AN 85–195279(32).

Abstract of SU 1 509 239 A; Sep. 23, 1989; Derwent Publications, AN 90–106122 (14).

Abstract of JP 52 005 373 A; Jan. 1977; Derwent Publications, AN 77–15137U(09).

"Thermosetting Resins", Plastics Handbook 10, Professor Dr. Wilbrand Woebcken, pp. 763–764 (no date).

"Thermosetting Resins", Plastics Handbook 10, Professor Dr. Wilbrand Woebcken, pp. 894–905 (no date).

"Thermosetting Resins", Plastics Handbook 10, Professor Dr. Wilbrand Woebcken, pp. 911–921 (no date).

"Water Compatible Phenolic Resins", John D. Fisher, (Schnectady Chemicals Inc.); *Proceedings of the American Chemical Society, Division of Polymeric Materials, Science and Engineering*, Spring Meeting 1991, vol. 64, 1991, Atlanta, GA, pp. 275–276 (no month).

*Primary Examiner*—Michael Marcheschi
(74) *Attorney, Agent, or Firm*—Scott R. Pribnow

(57) ABSTRACT

Surface conditioning articles comprising an organic matrix and water-based organic binders are reported. The water-based organic binders include a first binder and a second binder with abrasive particles dispersed and adhered within the second binder. The first binder comprises a mixture of a phenolic resin and a carboxylated butadiene-acrylonitrile copolymer latex, in the range of weight ratio of dry materials of said latex versus said phenolic resin of 90/10 to 60/40.

11 Claims, 6 Drawing Sheets

SURFACE CONDITIONING ARTICLES AND METHOD OF MAKING SAME

This application is a continuation of application Ser. No. 09/906,498, filed Jul. 16, 2001, now abandoned which is a continuation of application Ser. No. 09/068,839, filed May 15, 1998, now abandoned, which was the National Stage of International Application No. PCT/US96/19188, filed Nov. 27, 1996, and published in English under the PCT.

BACKGROUND

The present invention relates to surface conditioning articles formed from an organic matrix coated and engulfed by organic binders. The present invention also relates to a method for making a layered composite from which a surface conditioning article may be machined.

Surface conditioning articles are surface treatment articles formed from an organic polymeric matrix formed of a solid or foamed organic polymer or a nonwoven fiber web find utility in treating a surface to prepare it for further coatings. Burrs and flashing from cast, drilled or punched parts must be removed to produce a desired shape or surface finish. Surface conditioning articles in the form of wheels, discs, or belts operating at high speeds and high pressures must have sufficient strength and durability when subjected to high use pressure against the workpiece. It is desirous for the article to be flexible to intrude into crevices in the workpiece. In addition, the propensity of the article to smear onto the workpiece must be taken into consideration. Smearing is generally considered deleterious.

As used herein the term "smear-resistant" is meant to denote embodiments of the invention exhibiting substantially no visible signs of the surface treatment article remaining on the workpiece after the workpiece article has been treated. The articles of the invention call be urged against a workpiece at high operating speeds and/or pressures without smearing of the article onto the workpiece. The term "surface conditioning" is used here to include all steps between preliminary removal of material and final polishing or finishing step. Those steps comprise, grinding, lapping, deburring and the like.

Polymeric resinous binders used to bond the matrix or to secure abrasive particles within the matrix of such products have generally been either of the hard thermosetting type or the strong, tough elastomeric type. Hard thermosetting resins, such as base catalyzed phenol formaldehyde, are widely used to secure abrasive particles to sheet-like backing or to the fibers of a nonwoven web. Such hard resin binders, while usually having high tensile strength, low elongation at break or failure, and resistance to significant change when subjected to elevated temperatures, are undesirably susceptible to brittle fracture. Strong, tough elastomeric resin binders are more desirable in certain applications which require tougher, more durable surface treatment products. Such elastomeric binders have excellent tensile strength, a very high elongation at break, and resistance to brittle fracture but may exhibit significant softening at elevated temperatures as might be encountered when the surface treatment article is urged against a workpiece at high speeds and pressures. Such softening may result in smearing or transfer of portions of the article to the surface of the workpiece, which as described previously is not desired by the user.

The surface conditioning industry is continually striving for articles which more closely meet user demands. In addition, methods of producing surface conditioning articles that are kind to the environment, particularly the air and water, are especially strived for.

In light of the above user-driven demands it would be advantageous if surface conditioning articles could be developed which, by virtue of simple adjustment of binder ingredients, can be tailored to be flexible, substantially non-smearing at use pressure and temperature, all while using water-base formulations in the manufacturing processes which do not require use and subsequent removal of volatile organic hydrocarbons.

Specific properties needed for the coatings are linked to the final product applications. The product has to be flexible to be used in narrow and short belts form for example; it has to be conformable to allow uses on complicated surfaces; it has to be resistant to abrasion, and has to show resistant to brittle fracture to avoid an excessive wear of the product when used. It has to be resistant to high temperature occurring when used at high pressure/speed, and has not to let any smearing coating on the treated surfaces.

The standard reference product currently existing is made with urethane resins used in a solvent based system and catalyzed with an MDA (methylene dianiline). Several trials have been run to find a water base alternative to this resins use.

These articles have been made by the following generally known scheme. A first or "prebond" coating of a binder precursor solution without containing abrasive particles, which includes one or more of the above-named resins, is coated on the web and cured by, exposure to heat in order to impart sufficient strength to the nonwoven web for further processing. Then a "make" or "slurry" coating based on a resinous organic binder is applied to the web to secure fine abrasive grains throughout the lofty fibrous mat and cured. Thereafter, a "size" coating of resinous binder material and abrasive particles is applied, usually by spray-coating, over the prebonded web to increase the abrasive characteristics of the article, such as preventing the abrasive mineral from shelling. Then, the size coating is cured. The resins of the various "prebond", "slurry", and "size" coatings may be different.

The use of solvent-coated crosslinked urethanes in the "prebond" provides the requisite elasticity and protect nylon fibers of the web from attack by subsequently applied phenolic make coates used for bonding of mineral abrasive into the web.

The prebond coat is the most important one as far as smear resistance is concerned, because it protects the fibers from softening when using the article in heavy, high pressure.

Phenolic resin binders, in particular, are used extensively to manufacture nonwoven abrasive articles as a binder for the abrasive particles because of their thermal properties, availability, low cost, and case of handling. The monomers used in greatest volume to produce phenolic resins are phenol and formaldehyde.

In order to reduce emissions of "VOCs" (volatile organic compounds), it has been suggested to increase the water compatibility of phenolic resins. J. D. Fisher, in an article entitled "Water Compatible Phenolic Resins" in *Proceedings of the American Chemical Society, Division of Polymeric Materials: Science and Engineering;* no. 65, pp. 275–276 (1991), describes methods of making "water compatible" phenolic resins, their benefits, and their shortcomings.

Also, a compatibility problem arises from the use of the phenolic binder in particular together with a nonwoven web based on polyamide fibers. A particularly useful known nonwoven abrasive article is one comprising a web of polyamide fibers and resole-type phenolic resins as the curable binder. Such a composition provides for strong, tough, temperature resistant abrasive articles that may be made economically.

Rubber-modified phenolic resins have also been used in the manufacture of nonwoven abrasive articles, such as in the disclosure of commonly assigned U.S. Pat. No. 2,958,593 (Hoover et al.), as an optional rubber treatment disposed on one side of the structure to increase the resistance of the overall abrasive article structure to tearing and shredding. For example, Hoover et al. exemplifies a nylon fiber web being first coated with a phenol-formaldehyde and amine terminated polyamide resin-containing coating, followed by transmitting the phenol exposed web to a curing oven where the coated web is so heat-treated such that the emitted treated web is cured to a nontacky state while still warm, and, only thereafter, a rubbery composition based on a butadiene acrylonitrile copolymer latex (viz. trade designation "HYCAR LATEX 1561", from B.F. Goodrich Co.) is applied to the opposite side of the web and heat-cured in an oven.

The modification of a phenolic resin precursor system used for binding, lower tenacity polyamide web fibers by the presence of a low rate of butadiene acrylonitrile latex, less than 40%, as a modifier agent therewith which alleviates the degradation of polyamide fibers in the presence of phenol, has been disclosed in U.S. Pat. No. 5,591,239. In this patent, the function of the latex is to improve the mechanical characteristics of a phenolic impregnated web and especially reduce the tearing of the open low-density nonwoven abrasive article.

SUMMARY

The goal of the present invention is to provide surface conditioning articles which can be urged against a workpiece at high pressure and/or high speed with no undesirable smearing or other transfer of the article to the workpiece surface. The goal of the present invention is further to provide a surface conditioning article prepared with water-based formulations, said article having properties, especially, flexibility and smear resistance, equivalent to polyurethane standard reference article currently existing.

Water-based formulations for surface treating products having a wider range of possible use than the specific surface conditioning article of the present invention, have been disclosed in U.S. Pat. No. 5,306,319. The water-based formulations of U.S. Pat. No. 5,306,319 comprise binders consisting in a reaction product of polyurethane prepolymers or plurality of adducts. These adducts render the preparation method difficult and costly. Moreover, the properties do not totally respect all of the customers needs defined as "cut", "wear resistance", "smear resistance" and "flexibility" for the specific field of the surface conditioning article.

Another goal of the present invention is therefore to provide new water-based formulation is particularly useful as surface conditioning article, having a decrease in the products costs in respect of those disclosed in U.S. Pat. No. 5,306,319.

For doing this, a first aspect of the invention is a surface conditioning article comprising an organic matrix substantially engulfed by water-based organic binders including a first or "prebond" binder and a second or "slurry" binder with abrasive particles dispersed and adhered within said second binder, wherein the first binder comprises a mixture of a phenolic resin and a carboxylated butadiene-acrylonitrile copolymer latex, in the range of weight ratio of dry materials of said latex versus said phenolic resin of 90/10 to 60/40.

Phenolic resin provides hardness, cohesion, adhesion of the fiber web and between different layers, high thermal resistance to the coating, it is a perfect support for the layers which include minerals in abrasive applications. Phenolic may be too brittle and too hard to be used alone in an alternative coating to urethanes. Specificity of the phenolic resin used is preferably to present very high water tolerance to allow to support to be mixed with very high ratio of NBR latex dispersion and this without getting mixing compatibility problems (gellification). That is why it is necessary to have a phenolic resin no too much advanced in the condensation reaction (i.e. with a low molecular weight). Specific experiments have been needed to determine phenolic resin compatibility to NBR latex.

In a preferred embodiment, the said phenolic resin of the first binder is a resole-type phenolic resin with a water tolerance of at least 500% by weight. More particularly, the water tolerance comprises from 500 to 2500%. A water tolerance of 500% by weight means that the resin can be mixed with 5 times its own weight with water without precipitations.

In a preferred embodiment, said phenolic resin of the first binder has a molecular weight in the range of 100 to 1000.

An important function of the carboxylated butadiene-acrylonitrile latex (herein after referred to as "NBR" latex) in the present invention is to provide outstanding thermal resistance for a so flexible coating. This protects the fibers from softening at high temperatures. This gives to the final product flexibility and smearing resistance in the same time. This function is linked to the way carboxylated NBR latex degrades with temperature-cyclize before being destroyed by heat by, melting-in contrast to systems where such a cyclisation is not possible. They show no residual thermoplasticity whatever; that makes for example NBR latexes highly suitable items for brake lining and clutch plate facings.

NBR latex provides high flexibility (Tg close to −30° C.), conformability, softness, and very high resistance to flex fatigue and very good mechanical properties for such flexible coatings. It shows high resistance to abrasion and wear. It keeps high flexibility at low temperatures. In view of all these properties, it is preferred to use a carboxylated NBR latex with high acrylonitrile ratio especially wherein the said butadiene-acrylonitrile latex has a molar percentage of acrylonitrile of at least 25%. More particularly the molar percentage of acrylonitrile is from 25 to 35%.

In a preferred embodiment, the latex particles have a size in the range of 10 to 500 nm.

The articles of the invention have a wide available range of flexibility and smear-resistance, thus making them useful in articles designed to abrade a workpiece, deburr a workpiece, wipe the surface of a workpiece, or buff a workpiece. In addition, the inventive binder is applied to the organic matrix in the form of an aqueous composition, thus eliminating or substantially reducing the release of volatile organic compounds in the process of making the inventive articles. The carboxyl groups allow self crosslinking of the copolymer without use of catalyzing agent.

In one embodiment, the organic matrix comprises an open, lofty, three-dimensional nonwoven web of the article which comprises a plurality of organic polymeric fibers bound together at points where they contact by the first binder.

In a preferred embodiment of the present invention, the article comprises a third or "size" binder coated over the second binder, said third binder comprising a mixture of phenolic resin and carboxylated butadiene acrylonitrile copolymer latex.

More preferably, the weight ratio of dry materials of said latex versus said phenolic resin in the third binder is in the range of 60/40 to 40/60.

In one embodiment, the phenolic resin and carboxylated butadiene-acrylonitrile latex are the same in the first and third binders.

The phenolic resin of the first and third binders may be selected from commercial materials.

In particular appropriate embodiments of the present invention, the phenolic resin of first and third binders may be selected from the group consisting of phenolic resins commercially available under the trade designations "LACFEN420" (from Satef Huttens Albertus Spa) and "SW 378" (from Bakelite) and the butadiene-acrylonitrile latex is selected from the group of butadiene-acrylonitrile latexes commercially available under the trade designations "PERBUNAN N2890" (from Bayer) and "LN 240S" from BASF.

The second binder of the article according to the present invention may comprise conventional water-base resole-type phenolic resin.

Another aspect of the invention is a method of making a layered composite from which a surface conditioning article according to the present invention may be machined, the method comprising:

a) coating a major portion of the organic fibers of an open, lofty, three-dimensional nonwoven web with the first binder composition to form a first coated web;

b) exposing the first coated web to energy sufficient to at least partially cure the first binder composition to form an open, lofty, three-dimensional nonwoven prebonded web of fibers;

c) coating at least a portion of the fibers of the prebonded web with an aqueous slurry, comprising water, abrasive particles and a said second binder to form a second coated web;

d) exposing the second coated web to energy sufficient to cure the second binder;

e) coating at least a portion of the fibers of the second coated web with a third binder;

f) exposing the third coated web to energy sufficient to cure the third binder, remove substantially all the water, thereby forming a substantially dried web;

g) juxtaposing a plurality of substantially dried webs of step g) to form a precursor layered composite; and h) compressing the precursor layered composite with pressure and at a temperature sufficient to form the layered composite.

In one embodiment before step a), the method comprises:

1) forming an open, lofty, three-dimensional nonwoven web of organic fibers; and optionally 2) entangling the organic fibers of the nonwoven web to form all entangled web having an effective density.

Preferred are those methods wherein the layered composite is machined into the form of a surface conditioning article, in the form of a disc, wheel, endless belt, rectangular block, and the like.

The nonwoven web may be selected from commercial materials.

However, another aspect of the invention is a method of making an open, lofty nonwoven surface conditioning article, wherein the step a) comprises two sub-steps:

a) forming an open, lofty, three-dimensional nonwoven web of organic fibers; and b) entangling the organic fibers of the nonwoven web to form an entangled web having an effective density.

Surface conditioning articles of this inventions are suitable for use in a variety of applications. They may be adapted for use on any workpiece composition including metal, wood, plastics, composites, glass, ceramics, concrete, and others. They are designed for a use intermediate between the aggressive removal of material from a workpiece and clean a workpiece in preparation for painting, plating, etc.

Surface conditioning articles of the invention are especially effective in conditioning metals without substantial smearing onto the metal workpiece.

When the surface conditioning article of the invention is rotated against a workpiece under heat-generating conditions such as high wheel to workpiece pressure and surface speed, these conditions do not cause surface portions of the wheel to smear, or transfer onto the surface of the workpiece.

An important aspect of the invention is that articles of the invention employ inventive binders which allow the articles to exhibit a high flex fatigue resistance (in other words, able to deform and penetrate into grooves and indentations in a metal workpiece, and then return to its original shape, in a cyclic process).

The binders may contain optional functional additives or fillers such as colorants, thickening agent, pH buffering agent and scavengers. As previously stated, binders are applied to the organic matrix in the form of aqueous compositions (emulsions, dispersions, or slurries). The aqueous compositions may comprise plasticizers, viscosity modifiers, grinding aids and abrasive particles, the latter in the case of aqueous slurries.

Thickeners may be used to adjust the viscosity of the aqueous or solvent dispersed binder system, i.e., when in the liquid state, in order to provide for an easily-coatable composition. Examples of suitable thickeners include salt of polyacrylic acid carboxymethyl cellulose, guar gum, gum tragacanth, homo- and copolymers of poly(vinyl alcohol), methyl cellulose, modified starch, and the like. The thickening agent increases viscosity of the wet mix so that sufficient weight can be applied with a roll coat process on the fiber web.

Suitable pH buffering agents may include materials like triethanolamine and ammonia. pH buffering agent helps thickening efficiency without leaving residual basic component in the wet coating during drying.

Suitable scavengers may include materials like urea, or melamine. Scavengers minimize formaldehyde emissions of phenolic resins during drying.

Examples of colorants are inorganic pigments, organic dyes, and the like. Reinforcements may include, for example, short organic or inorganic fibers, spheres, or particles. Grinding aids may be materials such as poly(vinyl chloride), potassium fluoroborate, and the like. Fillers may include calcium carbonate, fumed silica, and other materials which are primarily inert with respect to the utility of the articles. Plasticizers may include, for example, phthalic acid esters, oils, and other relatively low molecular weight materials.

Abrasive particles are added to the binder system to render the inventive surface conditioning article more aggressive in its action on a workpiece. Such abrasive particles, employed to produce the surface conditioning articles of the present invention, may be any known abrasive material commonly used in the abrasive art. The abrasive granule size and type may be any of those commonly used to make surface conditioning articles. Examples of suitable abrasive particles include silicon carbide, aluminum oxide, cerium oxide, alumina zirconia, cubic boron nitride, garnet, pumice, sand, emery, mica, flint, talc, corundum, quartz, diamond, boron carbide, fused alumina, sintered alumina, alpha-alumina-based ceramic material (available from Minnesota Mining and Manufacturing Company, Saint-Paul, Minn. under the trade designation "CUBITRON"), and mixtures thereof. Agglomerate abrasive particles, such as those described in U.S. Pat. Nos. 4,652,275 and 4,799,939 may also find utility. Softer abrasive particles such as those made of thermoplastics or thermosetting material glass as well as other softer abrasive particles may be used for polishing applications. It is considered within the skill of the artisan to select the appropriate abrasive material for the particular use without undue experimentation.

The organic matrix serves the function of providing strength and structural integrity to the surface conditioning articles of the present invention. On a more fundamental basis, the organic matrix serves the function of providing a substrate for the binders and abrasive particles.

The organic matrix may be either a solid of foamed organic polymer or a nonwoven web comprised of organic fibers, preferably hydrophilic organic fibers. If hydrophilic organic fibers are employed, a heating step may be eliminated or reduced as the fibers will absorb water from the emulsified binder. An example of a lofty, nonwoven web formed of crimped staple fibers adhered at points of contact with binder which contains abrasive particles is taught in U.S. Pat. No. 2,958,593 (Hoover et al.). U.S. Pat. No. 4,227,350 (Fitzer) discloses a matrix formed of three-dimensionally undulated inter-engaged autogenously bonded continuous filaments.

The organic matrix may be comprised of thermoplastic organic staple fibers, such is nylon (polyamide), polyester, and the like staple fibers or a combination of thermoplastic and cellulosic staple fibers, such as viscose rayon, and the like. Preferred thermoplastic fibers are nylon staple fibers, especially nylon 6,6. If a combination of thermoplastic organic fibers and cellulosic fibers are employed the weight of cellulosic fibers as a percentage of the total fibers weight may range from about 5 weight percent to about 50 weight percent.

In a preferred embodiment, said open, lofty, three-dimensional nonwoven web comprises organic polyester or polyamid fibers.

The fibers preferably have denier ranging from about 10 to 100 and length ranging from about 10 to 100 mm.

Surface conditioning articles within the present invention may take any of a variety of conventional forms such as sheets, blocks, strips, belts, brushes, rotary flaps, discs, or solid or foamed wheels. Especially useful forms are wheels in the form of a disc or right circular cylinder having dimensions which may be very small, e.g., a cylinder height on the order of a few millimeters, or very large, e.g., two meters or more, and a diameter which may be very small, e.g., on the order of a few centimeters, or very large, e.g., one meter or more. The wheels typically have a central opening for support by an appropriate arbor or other mechanical holding means to enable the wheel to be rotated in use. Wheel dimensions, configurations, means of support, and means of rotation are well known in the art. A useful summary of various wheel forms of surface treatment articles which may be made using the inventive binders are described in the publication "3M Wheels", published in 1990 by Minnesota Mining and Manufacturing Company, Saint Paul, Minn. ("3M"), which is incorporated herein by reference.

Surface treatment articles of the present invention in which the organic matrix is engulfed by a binder may be prepared by forming a layered composite. Layered composites (known in the art as "slabs") may be produced by cutting, punching, or otherwise machining uncured or partially cured webs into sheets or discs which are then overlapped on one another and then compressed and cured to make a higher density, slab. Such cutting, punching and other machining techniques are well known to those skilled in the art.

A layered composite may be used as the source of a multitude of articles of the invention each having various diameters, or all the same diameter, as required by the user. Article of the invention may be produced form the layered composites by machining using appropriate techniques which are also well known in the art. For example, a wheel shape may be die cut from a slab of the layered composite. Additionally, ribbons, strips, or elongate segments of the layered composite may be spirally wound into a wheel shape while the binder is uncured or partially cured and then fully cured to yield a wheel.

BRIEF DESCRIPTION OF THE DRAWINGS

Further aspects and advantages of the invention will become apparent from the drawing figures and description of preferred embodiments and examples which follows.

DETAILED DESCRIPTION

General Features of the Product Preparation

Figure 1:
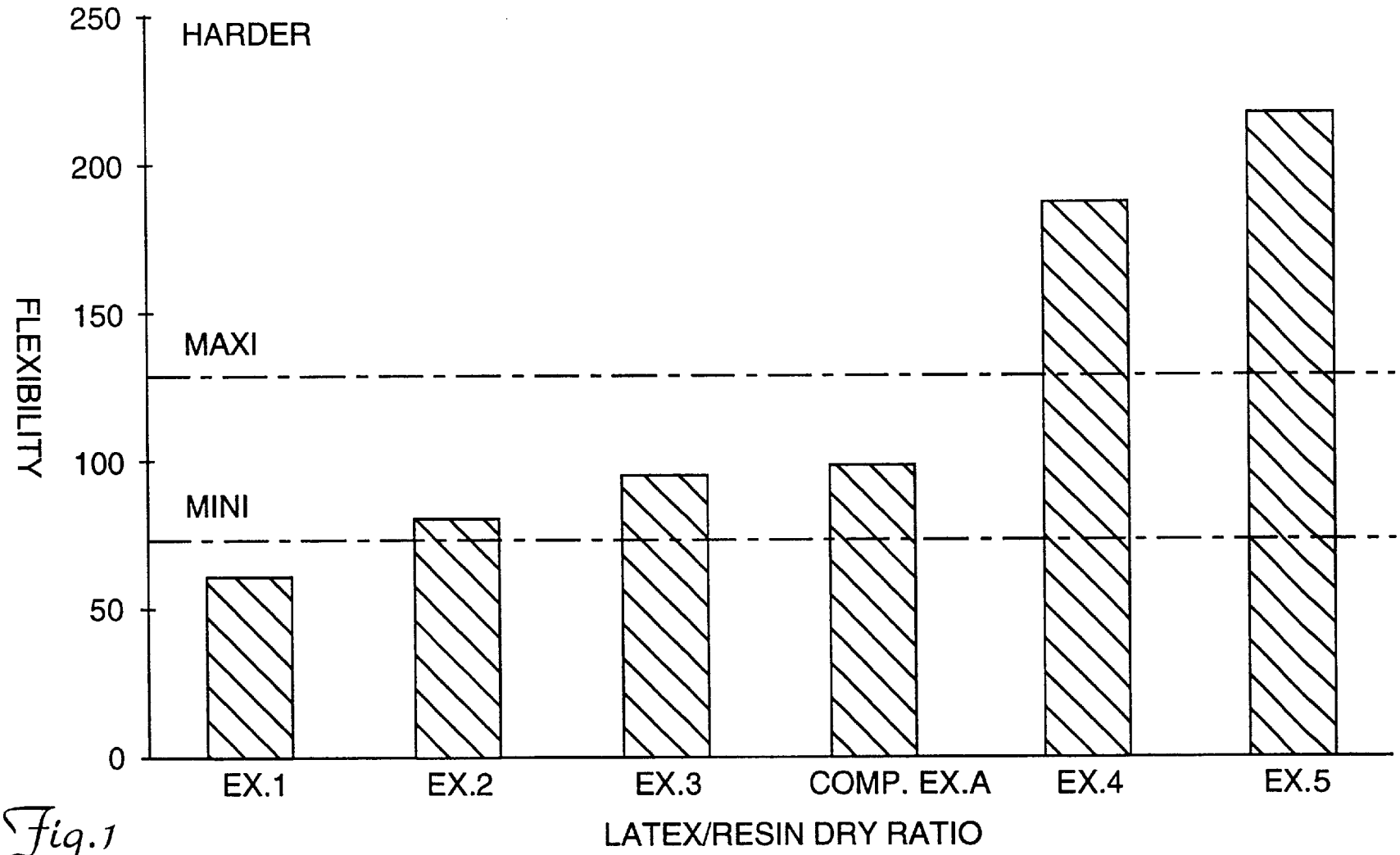
FIG. 1 represents the results of the prebond study of flexibility versus latex/resin dry ratio of the example products.

All the following concerned products are made in four steps.

These four steps are:

1.1. Fiber web forming: A non woven web is formed on a basis of nylon fibers (polyester or other types could be used too) dimensions of the fibers can go from about ten to several hundred deniers for the diameter and from about several ten to several hundred mm for the length, they can be crimped or not. The web can be made with several processes: air laid (Rando), carding, cross lapping, needle tacking. A woven scrim (Nylon, DEF, or other type of fabrics) can be used as an "inside" basis to consolidate the nonwoven web, the cloth can be included to the web by Needle tacking for example.

In the hereinafter detailed examples the fiber web forming is made as follows. The web fiber is made of Nylon fiber (Supplier: Wellman International Ltd), 60 deniers and 100 deniers fibers are used, length of these staple fibers are approximately 76 mm.

The web is preformed on a carding machine (from OCTIR Spa Italia), eight layers are made with a cross lapping machine (from ASSELIN France) to consolidate the fiber web. Its weight is about 300/350 g/m$^2$. The web is then needle tacked on a Needle tacking machine (from FEHRER AG Austria); the fiber web is needle tacked on a Nylon (or PET) woven fabrics (described hereafter in a Raw Material list) of 150 g/m$^2$ which upgraded the use of the final product in belts applications.

The web thickness is from 5 to 15 mm depending of the product grade made.

1.2. Prebond Roll coat: The fiber web is saturated in its thickness with a polymers-system applied with a roll coating process. Generally, the coating used provides to the product flexibility and conformability but in the same time mechanical and thermal resistance characteristics needed for the final product application at high speed and pressure. The coated prebond weight is adapted to the fiber web design so that correct fibers saturation is achieved (i.e. about ten to several thousands grams per square meters). The coating is then dried in an oven with temperatures about 90 to 170° C. and times above ten minute so that untacky material can be usable for the next step. More particularly, in the hereinafter detailed examples the prebond step is dried at 90/110° C. during 15 mn.

1.3. Slurry spray: the previous prebond is then sprayed oil one side surface with a mix generally made with both basic components Phenolic resin and the abrasives particles. The coating used provides high mechanical and thermal resistance characteristics needed for the final product application at high speed and pressure, especially "cut" and "wear resistance". The sprayed slurry weight is adapted to the application needs (i.e. about ten to several thousands grains per square meters). The coating is then dried in an oven with temperatures about 100 to 170° C. and times less than ten minutes to provide enough energy so that resin cure can be completed. More particularly, in the hereinafter detailed examples, the slurry spray step is dried at 100/145° C. during 6 mn.

1.4. Size spray: The previous material is a new time sprayed on the same side surface with a mix made with a polymeric system. Generally the coating used must provide an outside layer which can protect the previous mineral coating of an excessive initial wear during use at high speed and pressure. The coated size spray weight must be adapted to the application needs (about ten to several thousands grams per square meters). The coating is then dried in an oven with temperatures about 100 to 170° C. and times more than one hour to provide enough energy so that resin cure can be completed. More particularly, in the hereinafter detailed examples, the size step (and the completed product) is cured at 100/145° C. during 2 hours.

1.5. Converting: After the making steps, the product in a jumbo form can be converted in a very wide forms range, for example, discs, belts, hand pads, rolls, wheels, brushes.

EXAMPLES

2. Test Methods 2.1. Performance test in belt form: "cut" and "wear": Product is converted in an endless belt form with following dimensions 2500 mm long per 50 mm width. A rectangular piece of material is cut in tile length direction, the dimension of the piece depends of the dimensions of the belts needed. Then both extremities of the rectangular product piece are joined and glued by an adhesive which will provide sufficient adhesion so that the splice will stay glued during application. Belt is placed on a backstand machine. Machine speed is 2830 rpm, contact wheel is rubber made with a hardness range of 80/90 shores and a diameter of about 200 mm; it presents serrated valleys at 1/1 ratio with an angle of 45°.

Grinding materials used are steel bars (XC 38 ref.) dimensions are 200 mm long per 20 mm diameter. Bars, placed in a holder, are presented its length to the belts in an horizontal way.

Pressure used for grinding is 5.8 kg for the 50 mm belt width. Running cycle is 30 seconds, and is repeated 24 times on a different bar face (4 per bar).

The loss of removed steel on each bars is measured and reported as "cut", the loss if the belt weight is measured at the end of the test and reported as "wear", "efficiency" represents the ratio "cut/wear".

2.2. Performance test in disc form: "cut" and "wear": Product is concerted in a disc form of 178 mm diameter with a centered hole and fix on a holder (3M Brand Disc Pad holder European ref. 09921). A pneumatic portable machine (type Brand G. Renoult PL 120 with an operating speed of 2000 rpm) is used to perform the test. This pneumatic device is mounted on a robotics station (type brand ABB 3000 from Asea Boveri Brown St-Ouen I'Aumone, France) equipped with a compliance system which controls pressure). The portable tool with a disc mounted on it, is presented by the robotics-station to a holder which supports 20 stainless steels sheets. These sheets (30×80×1 mm) are 5 mm spaced from one to the other and are placed in vertical way, the length inside the holder. The running disc grinds these sheets on the sharpest side from left to right, and this two times. Pressure is approx 4 kg and running speed approx. 16 mm per seconds, angle between disc and floor is close to 7°. The loss of removed steel on each bars is measured and reported as "cut", the loss of the belt weight is measured at the end of the test and reported as "wear", "efficiency" represents the ratio "cut/wear".

"Cut" is the quantity of material which is removed from the grinded piece during the time the test is performed. This "cut" is calculated by comparing the weight of the bars before and after the test. The number represents the ability, of the abrasive product to remove material like rust or paint during typical applications.

"Wear" is the quantity of material that the abrasive product (belt or disc forms) is losing during the time the test is performed. The "wear" is calculated by comparing the weight of the samples before and after the test, and then divided by the initial material weight (results in %). This number represents the life time of the product, as the more the product will "wear", the less it will be used in terms of time units during when the product is usable.

2.3. Performance test: hand tool evaluation (in disc form): Product is converted in a disc form of 178 mm diameter without centered hole and fix on a holder (3M Brand disc Pad holder ref. 0917). A pneumatic portable machine (type Brand G. Renault PLI20 with an operating speed of 2000 rpm) is used to perform the test. An operator performs the tests following usual uses of the product application.

Edge resistance is visually evaluated after having grinded the edge of a carbon steel block during approx 20 seconds. Performance of the product is represented by the time needed to remove the paint coating from a standard painted sheet used for automotive applications. Loading resistance is visually evaluated after having removed this paint coating. Smearing resistance can be visually evaluated by looking if the disc has left a "smearing coating" on simple stainless sheet and with heavier hand pressure.

2.4. Performance test: finish & smearing resistance evaluation: Product is converted in a disc form of 178 mm diameter without centered hole and fix on a holder (3M Brand disc Pad holder ref. 0917). A pneumatic portable machine (type Brand G. Renault PL 120 with an operating speed of 2000 rpm) is used to perform the test. This pneumatic device is mounted on a robotics station (type Brand ABB 3000 equipped with a compliance system which controls pressure). The portable tool with a disc mounted on it, is presented by the robotics station to a stainless steel sheet of 50×50 cm with an initial finish quality reference 2B. The machine performs two runs on the metal from top to bottom with a rotating speed of 2000 rpm, length of the grinded metal is approx. 30 cm in approx. 15 seconds, pressure is controlled to 4 kg and running angle is close to 7°.

Finish level is evaluated with roughness measurements oil a Perthometer device (ref. PRK S8P from Mahr Perthen Cy-Göttlinger-D3400 Germany); the roughness values Ra, Rz and Rmax are registered.

Smearing resistance is visually evaluated by looking if the disc has left a "smearing coating" on the stainless sheet.

2.5. Flexibility evaluation method: One sample of each the experimental tested products (dimension 10×15 cm, shape: rectangular) is given to people skilled in the art of nonwoven, abrasives . . . It is then asked to the people to ranked the product samples from the more flexible to the more rigid by feeling the flexibility of the product for example by folding it between their hands. Then it is asked to these people to evaluate the level of flexibility of the tested sample by giving it a number which represents its flexibility by comparing it to the comparative example (A) which is fixed to a reference value of 100. If the tested product feels more flexible than the reference its flexibility value will be lower than 100 and if it feels more rigid, it will be higher than 100. The range of acceptable flexibility is from 25 to 125 i.e. +/−25 around the target value of the reference which is 100.

3. Reference Comparative Product: Comparative Example A

This product is the current existing standard product made in a 3M US plant (Prairie du Chien WI). The design described is defined for product called "SC A Coarse with scrim". The fiber used is a mixture of 70 to 58 deniers type needle tacked on a nylon open scrim.

Prebond roll coat formulation is based on the use of flexible urethane resin (BL 16 adiprene from Uniroyal Inc.) catalyzed by methylene dianiline (MDA in PM acetate solvent). PM acetate solvent is used for adapting viscosity to coating process. Lithium stearate is used for helping in smearing resistance during use at high pressure/speed producing elevated temperatures. Brown pigment is used for appearance reason. Slurry spray is made with 80 grit A1203 with phenolic resin to bond mineral together and mineral to previous layers. EPICURE amine functional curing agent is used as a phenolic resin curing agent. PM ether solvent is used for adapting viscosity to spraying process. Ace Lube premix is used for helping in smearing resistance during use at high pressure/speed producing elevated temperatures. Other "grades" of products like medium or fine type use finer minerals.

Size spray formulation is based on the use of flexible urethane resin (BL31 adiprene from Uniroyal Inc.) catalyzed by methylene dianiline (MDA in PM acetate solvent). PM acetate solvent is used for adapting viscosity to coating process. Size cannot be made on other grades products.

The Raw Material trade designations and supplier of the specific components of the comparative example A resumed in the hereinafter table are the following:

"ADIPRENE BL16" and "ADIPRENE BL31" are ketoxime blocked isocyanate prepolymers (available from UNIROYAL Corp. Middlebury CY).

"MDA in PM acetate solution" is a mix of 35% MDA in 65% PM acetate solvent.

"MDA" is p, p' methylene dianiline available from CIBA GEIGY Corp. Crimsby, Scotland.

"PM acetate" is propylene monomethylether acetate available under the trade designation "DOWANOL PMA" from Dow Chemicals USA Midland Mich.

"Lithium stearate premix" is a mix made of 44% lithium stearate and 56% PM acetate solvent.

"Lithium stearate" is available under trade designation "TYPE FS" from Witco Corp. Chicago Ill.

"Ace lube premix" is a mix made of 80% of hydrocarbon distillate available under the trade designation "ACE-LUBE 23N" (from Gopher Oil Cy Minneapolis, Minn.) and 20% of 325 mesh bentonite available under the trade designation "VOLCAY" (from American Colloid cy Arlington Heights, Ill).

"EPICURE 852" is an amine functional curing agent (available from Rhone Poulenc Inc. Princeton, N.J.).

Comparative Example A

| DESIGNATION | RM Qty % | Wet Qty Gr/SQM | % solids | Dry qty Gr/SQM |
|---|---|---|---|---|
| Fiber web | | | | |
| Nylon scrim | | | | 150 |
| 70 denier nylon fiber | | | | 200 |
| 58 denier nylon fiber | | | | 86 |
| Sub total | | | | 436 |
| Prebond Roll Coat | | | | |
| Adiprene BL 16 | 62.3 | | | |
| MDA in PM acetate solution | 19.2 | | | |
| PM acetate | 13.7 | | | |
| Lithium Stearate Premix | 3.6 | | | |
| Brown Pigment | 1.2 | | | |
| Sub total | 100.0 | 642 | 65 | 417 |
| Slurry Spray | | | | |
| PM ether | 13.1 | | | |
| Phenolic resin | 16.7 | | | |
| 80 grit A1203 | 62.5 | | | |
| Ace lube Premix | 3.0 | | | |
| Epicure 852 | 4.7 | | | |
| Sub total | 100.0 | 1353 | 82 | 1109 |
| Size Spray | | | | |
| Adiprene BL31 | 40.0 | | | |
| PM acetate | 39.1 | | | |
| MDA in PM acetate solution | 20.9 | | | |
| Sub total | 100.0 | 473 | 32 | 151 |
| Total | | 2262 | | 2113 |

4. Example Products

These example-products are called "SC A Coarse with scrim". The fibers used are 60 or 100 deniers type and the scrim nylon or PET depending of the example references.

Prebond roll coat formulation is based on the use of flexible system based on a mix of high water tolerant phenolic resin and NBR latex. This mix, because of raw materials properties, is particularly designed to provide high smearing resistance during use at high pressure/speed producing elevated temperatures. Additive like thickening agent (with Triethanolamine as pH buffer) is used for adapting viscosity to coating process and for mix stability. Additive like melamine and urea are used as formaldehyde emissions (from phenolic resin) as scavengers. Brown pigment is used for appearance reason. Dry ratio phenolic resin to NBR latex are different depending of the example references.

Slurry spray is made with a mix of 80 A1203 grit with phenolic resin to bond minerals together and mineral to previous layers. Calcium carbonate is used to get a constant mix. Additives like carboxymethylcellulose (CMC) and acrylic resin are used to help to avoid minerals settling down in the wet mix. Water is used for adapting viscosity to spraying process. Additive like melamine is used as formaldehyde emissions (from phenolic resin) as a scavenger. Brown pigment is used for appearance reason. Other "grades" of products like medium or fine type use finer minerals. Other mineral types or mixes can be used depending of example references.

Size spray formulation is based on the use of flexible system based on a mix of high water tolerant phenolic resin and NBR latex. This mix, because of raw materials properties, is particularly designed to provide high smearing resistance during use at high pressure/speed producing elevated temperatures. Water is used for adapting viscosity to coating process. Additive like triethanolamine (as pH buffer) is used for mix stability. Additive like melamine is used as formaldehyde emissions (from phenolic resin) as scavengers. Brown pigment is used for appearance reason. Size cannot be made on other grades products.

5. Raw Material Characteristics of the Phenolic Resin and NBR Latex of Prebond and Size Binders

| | | |
|---|---|---|
| 5.1. | Product type | Phenolic resin |
| | product name | LACFEN420 |
| | Supplier name | Satef Huttenes Albertus Spa-Italy |
| | Main characteristics | solids 60–62% (3 hrs at 135° C.)<br>Brookfield viscosity: 40/60 cps<br>cure time: at 120° C.: 15' +/− 1<br>pH: 8.5 +/− 1<br>Free phenol: 0.9/1.0%<br>Free formaldehyde: 3.0/3.5%<br>Medium MW = 180–190 |
| 5.2. | Product type | NBR latex<br>(butadiene-acrylonitrile copolymer with carboxylic groups self crosslinking colloidal dispersion) |
| | product name | PERBUNAN N 2890 |
| | Supplier name | BAYER |
| | Main characteristics | solids 41 +/− 0.5%<br>Dispersion type: anionic/non anionic<br>Volumic weight: 1.02 g/cm$^3$<br>pH: 7.5 +/− 1<br>Brookfield viscosity: approx 14 cps (SL 1S60)<br>Particles size: approx 100 nm<br>High nitrile ratio: 28% |
| 5.3. | Other components | |

| NAMES | SUPPLIERS |
|---|---|
| CARBOSOL CMC | LAMBERTI SpA |
| Brown Pigment (Marrone Permasol-Mu) | SICOM SRL |
| 80 Grit AL203 | SMYRIS ABRASIVI SRL |
| 100 Grit AL203 | SMYRIS ABRASIVI SRL |
| POLICRIL 307 R RESINE SpA | FAR FABRICA ADESIVI |
| Melamine powder | BASLINI SpA |
| Calcium carbonate | MAFFE1 SpA |
| Tea (Triethanolamine 85) | IPCOCHEMICALS SpA |
| Nylon Scrim (Nylon 6363/8401 Scrim) | TESSITURA QUADRELLI SpA |

-continued

| | |
|---|---|
| 60 denier fiber (Nylon 6.6 100 Denari) | WELLMAN INTERNATIONAL LTD |
| 100 denier fiber (Nylon 6.6 100 Denari) | WELLMAN INTERNATIONAL LTD |
| Liquid melanine (Cellofix M/50) | LAMBERTI SpA |
| POLICRIL A/D | FAR SpA |
| Technical urea | BASLINI SpA |
| BUTOFAN LN 240S | BASF |
| Nylon Scrim or Polyester terephtalate (PET) Scrim | TESSITURA QUADRELLI SpA |
| Main characteristics | 6.3 × 6.3 grams/m$^2$<br>weight 150 g/m$^2$<br>tensile 438 N:cm<br>thickness 0.46 mm |

6. Effect of the Ratio of each Component of the Water Mix on the Example Product Performance The balance of quantity of each part in the mix has to be established so that product performance is best.

6.1. At the prebond level: Several experiments have been made to establish what are the effect of the dry, ratio latex/resin in the prebond making step on the product performance. Experimental products are described as following:

Example 1 is a full latex NBR coated prebond

Example 2 is a prebond made with a dry ratio of 90 of latex and 10 of resin

Example 3 is a prebond made with a dry ratio of 70 of latex and 30 of resin

Example 4 is a prebond made with a dry ratio of 50 of latex and 50 of resin

Example 5 is a prebond made with a dry ratio of 30 of latex and 70 of resin.

"R-M" means "Raw materials".

"Qty," means "Quantity," in terms of percentage of the concerned component.

"Gr/SQM" means "gram per square meter".

The total weight ("Wet Qty") and dry, weight ("Dry Qty") of each coating are given.

Experimental products have been compared to the reference "urethan-solvent-based" product industrially made and used.

Performance tests of the products with different ratios latex/resin have been carried out as follows:

Flexibility have been studied with sensitive "hand" evaluation according to the method described herein above. Cut & wear have been studied with the method herein above described. Finish level and "smear resistance" have been studied with the method herein above described.

Figure 2:
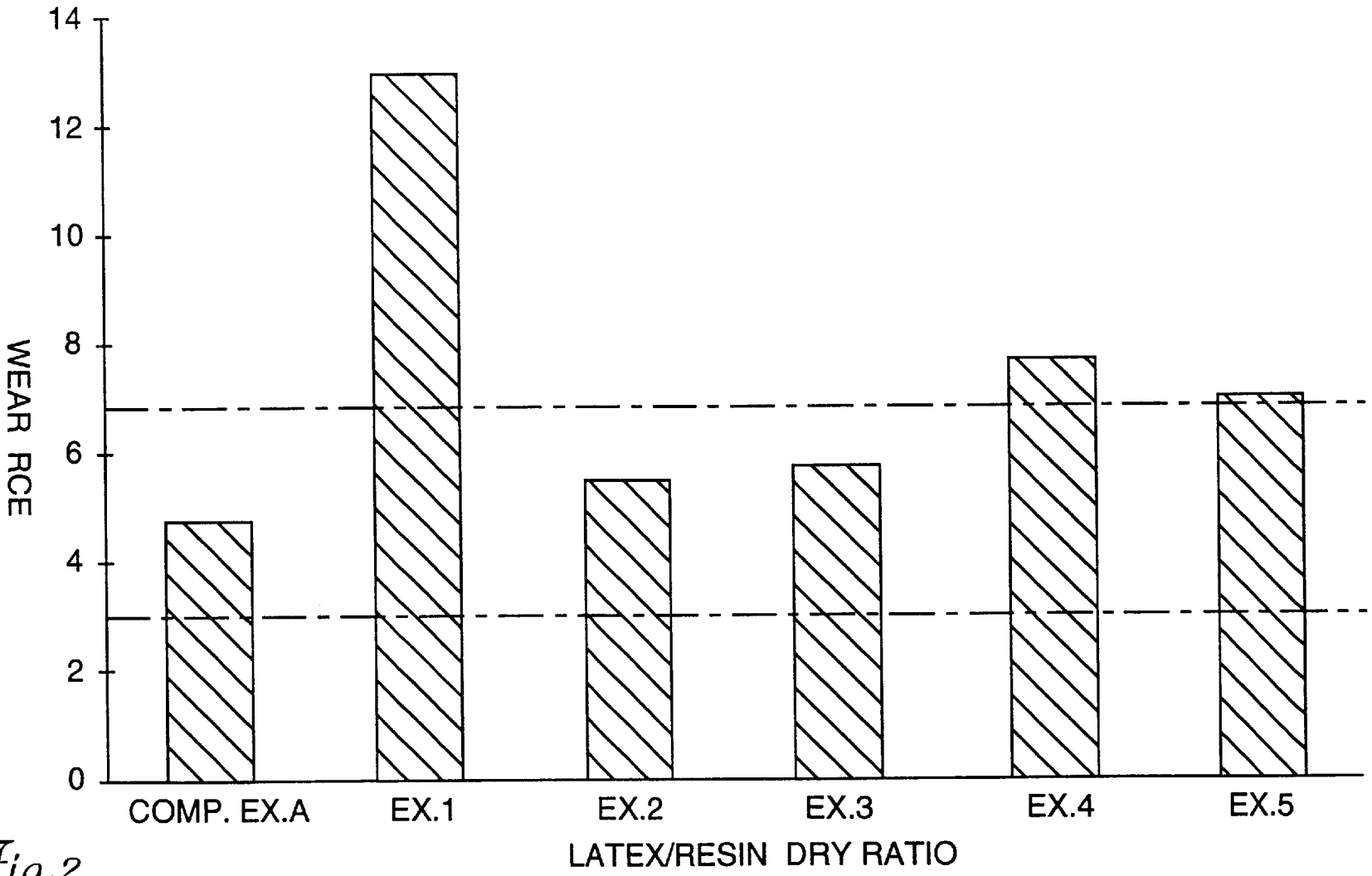
FIG. 2 represents the results of the preferred study of the wear resistance versus latex/resin dry ratio of the example products.
Figure 3:
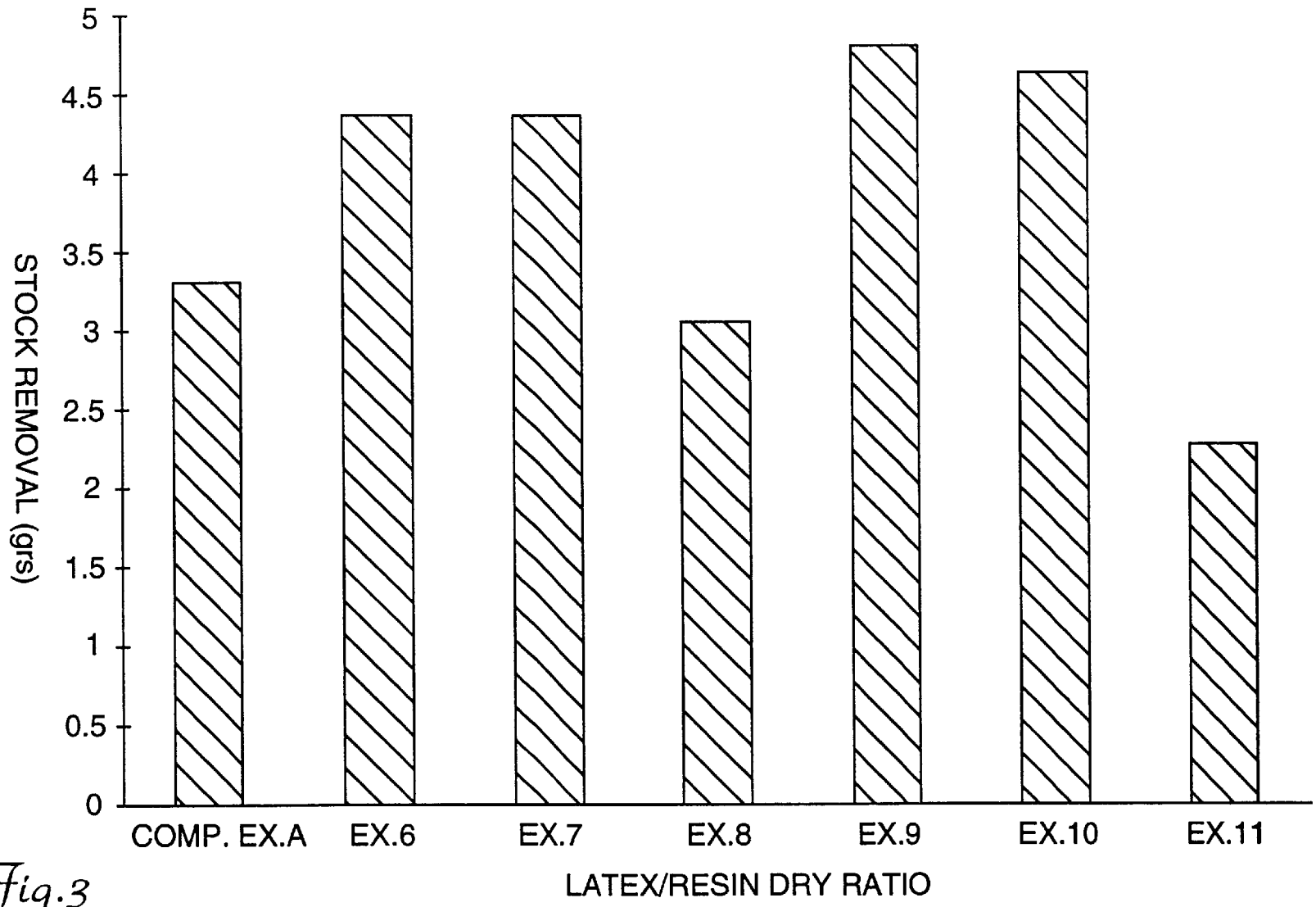
FIG. 3 represents the results of the prebond study of the "cut" versus latex/resin dry ratio of the example products.

The results are reported in the FIGS. 1 to 3.

Products with prebond made with 90/10 to 70/30 ratios are considered in the good flexibility range compared to the reference product (+/−25% compared to 100 basis for the standard product). For the test 6 persons have tested the products flexibility, and the 6 have given the same answers.

The 50/50 and 30/70 latex/resin samples were felt too rigid compared to the comparative example A. These products (50/50 and 30/70) will not be able to be used in applications where flexibility is needed as for example in belts applications.

Products with prebond made with 90/10 to 70/30 ratios are showing "wear resistance" which are in the acceptable limits of the performance results. All products are showing good cut. None of the products are showing "smearing". All products are showing acceptable finish level.

In conclusion, products made with prebond dry ratio latex/resin from 90/10 to 70/30 are showing better performance.

Example 1

Experimental Product

Dry Ratios: Prebond: 100 latex Size: 60/40 latex/resin

| DESIGNATION | RM Qty % | Wet Qty Gr/SQM | % solids | Dry qty Gr/SQM |
|---|---|---|---|---|
| Fiber web | | | | |
| Nylon scrim | | | | 150 |
| 60 denier nylon fiber | | | | 300 |
| Sub total | | | | 450 |
| Prebond Roll Coat | | | | |
| PERBUNAN N 2890 latex | 95.0 | | | |
| CARBOSOL CMC | 4.0 | | | |
| Dye-Marrone permasol MU | 1.0 | | | |
| Sub total | 100.0 | 1000 | 41 | 410 |
| Slurry Spray | | | | |
| water | 7.0 | | | |
| CARBOSOL CMC | 2.0 | | | |
| 80 grit A1203 | 33.6 | | | |
| 100 grit A1203 | 16.8 | | | |
| LACFEN415 phenolic resin | 20.2 | | | |
| POLICRIL 307R acrylic resin | 10.9 | | | |
| Melamine in powder | 1.2 | | | |
| Calcium carbonate | 7.4 | | | |
| Dye-Marrone permasol MU | 0.9 | | | |
| Sub total | 100.0 | 1901 | 80 | 1521 |
| Size Spray | | | | |
| LACFEN420 phenolic resin | 22.5 | | | |
| Triethanolamine 85 | 2.0 | | | |
| BUTOFAN LN240S latex | 55.0 | | | |
| Dye-Marrone permasol MU | 1.0 | | | |
| water | 19.4 | | | |
| Sub total | 100.0 | 177 | 45 | 79 |
| Total | | 3528 | | 2460 |

Example 2

Experimental Product

Dry Ratios: Prebond: 90/10 latex/resin Size: 60/40 latex/resin

| DESIGNATION | RM Qty % | Wet Qty Gr/SQM | % solids | Dry qty Gr/SQM |
|---|---|---|---|---|
| Fiber web | | | | |
| Nylon scrim | | | | 150 |
| 60 denier nylon fiber | | | | 300 |
| Sub total | | | | 450 |
| Prebond Roll Coat | | | | |
| LACFEN420 phenolic resin | 6.7 | | | |
| Triethanolamine 85 | 0.3 | | | |
| PERBUNAN N 2890 latex | 88.0 | | | |
| CARBOSOL CMC | 4.1 | | | |
| Dye-Marrone permasol MU | 0.9 | | | |
| Sub total | 100.0 | 961 | 42 | 404 |

-continued

| DESIGNATION | RM Qty % | Wet Qty Gr/SQM | % solids | Dry qty Gr/SQM |
|---|---|---|---|---|
| Slurry Spray | | | | |
| water | 7.0 | | | |
| CARBOSOL CMC | 2.0 | | | |
| 80 grit A1203 | 33.6 | | | |
| 100 grit A1203 | 16.8 | | | |
| LACFEN415 phenolic resin | 20.2 | | | |
| POLICRIL 307R acrylic resin | 10.9 | | | |
| Melamine in powder | 1.2 | | | |
| Calcium carbonate | 7.4 | | | |
| Dye-Marrone permasol MU | 0.9 | | | |
| Sub total | 100.0 | 1901 | 80 | 1521 |
| Size Spray | | | | |
| LACFEN420 phenolic resin | 22.5 | | | |
| Triethanolamine 85 | 2.0 | | | |
| BUTOFAN LN240S latex | 55.0 | | | |
| Dye-Marrone permasol MU | 1.0 | | | |
| water | 19.4 | | | |
| Sub total | 100.0 | 177 | 45 | 79 |
| Total | | 3489 | | 2454 |

Example 3

Experimental Product

Dry Ratios: Prebond: 70/30 latex/resin Size: 60/40 latex/resin

| DESIGNATION | RM Qty % | Wet Qty Gr/SQM | % solids | Dry qty Gr/SQM |
|---|---|---|---|---|
| Fiber web | | | | |
| Nylon scrim | | | | 150 |
| 60 denier nylon fiber | | | | 300 |
| Sub total | | | | 450 |
| Prebond Roll Coat | | | | |
| LACFEN420 phenolic resin | 20.7 | | | |
| Triethanolamine 85 | 0.9 | | | |
| PERBUNAN N 2890 latex | 73.3 | | | |
| CARBOSOL CMC | 4.1 | | | |
| Dye-Marrone permasol MU | 0.9 | | | |
| Sub total | 100.0 | 955 | 44 | 420 |
| Slurry Spray | | | | |
| water | 7.0 | | | |
| CARBOSOL CMC | 2.0 | | | |
| 80 grit A1203 | 33.6 | | | |
| 100 grit A1203 | 16.8 | | | |
| LACFEN415 phenolic resin | 20.2 | | | |
| POLICRIL 307R acrylic resin | 10.9 | | | |
| Melamine in powder | 1.2 | | | |
| Calcium carbonate | 7.4 | | | |
| Dye-Marrone permasol MU | 0.9 | | | |
| Sub total | 100.0 | 1901 | 80 | 1521 |
| Size Spray | | | | |
| LACFEN420 phenolic resin | 22.5 | | | |
| Triethanolamine 85 | 2.0 | | | |
| BUTOFAN LN240S latex | 55.0 | | | |

-continued

| DESIGNATION | RM Qty % | Wet Qty Gr/SQM | % solids | Dry qty Gr/SQM |
|---|---|---|---|---|
| Dye-Marrone permasol MU | 1.0 | | | |
| water | 19.4 | | | |
| Sub total | 100.0 | 177 | 45 | 79 |
| Total | | 3483 | | 2470 |

Example 4

Experimental Product

Dry Ratios: Prebond: 50/50 latex/resin Size: 60/40 latex/resin

| DESIGNATION | RM Qty % | Wet Qty Gr/SQM | % solids | Dry qty Gr/SQM |
|---|---|---|---|---|
| Fiber web | | | | |
| Nylon scrim | | | | 150 |
| 60 denier nylon fiber | | | | 300 |
| Sub total | | | | 450 |
| Prebond Roll Coat | | | | |
| LACFEN420 phenolic resin | 37.0 | | | |
| Triethanolamine 85 | 1.9 | | | |
| PERBUNAN N 2890 latex | 55.5 | | | |
| CARBOSOL CMC | 4.6 | | | |
| Dye-Marrone permasol MU | 1.1 | | | |
| Sub total | 100.0 | 854 | 49 | 418 |
| Slurry Spray | | | | |
| water | 7.0 | | | |
| CARBOSOL CMC | 2.0 | | | |
| 80 grit A1203 | 33.6 | | | |
| 100 grit A1203 | 16.8 | | | |
| LACFEN415 phenolic resin | 20.2 | | | |
| POLICRIL 307R acrylic resin | 10.9 | | | |
| Melamine in powder | 1.2 | | | |
| Calcium carbonate | 7.4 | | | |
| Dye-Marrone permasol MU | 0.9 | | | |
| Sub total | 100.0 | 1901 | 80 | 1521 |
| Size Spray | | | | |
| LACFEN420 phenolic resin | 22.5 | | | |
| Triethanolamine 85 | 2.0 | | | |
| BUTOFAN LN240S latex | 55.0 | | | |
| Dye-Marrone permasol MU | 1.0 | | | |
| water | 19.4 | | | |
| Sub total | 100.0 | 177 | 45 | 79 |
| Total | | 3382 | | 2469 |

Example 5

Experimental Product

Dry Ratios: Prebond: 30/70 latex/resin Size: 60/40 latex/resin

| DESIGNATION | RM Qty % | Wet Qty Gr/SQM | % solids | Dry qty Gr/SQM |
|---|---|---|---|---|
| Fiber web | | | | |
| Nylon scrim | | | | 150 |
| 60 denier nylon fiber | | | | 300 |
| Sub total | | | | 450 |
| Prebond Roll Coat | | | | |
| LACFEN420 phenolic resin | 55.7 | | | |
| Triethanolamine 85 | 2.7 | | | |
| PERBUNAN N 2890 latex | 35.5 | | | |
| CARBOSOL CMC | 4.9 | | | |
| Dye-Marrone permasol MU | 1.1 | | | |
| Sub total | 100.0 | 788 | 53 | 418 |
| Slurry Spray | | | | |
| water | 7.0 | | | |
| CARBOSOL CMC | 2.0 | | | |
| 80 grit A1203 | 33.6 | | | |
| 100 grit A1203 | 16.8 | | | |
| LACFEN415 phenolic resin | 20.2 | | | |
| POLICRIL 307R acrylic resin | 10.9 | | | |
| Melamine in powder | 1.2 | | | |
| Calcium carbonate | 7.4 | | | |
| Dye-Marrone permasol MU | 0.9 | | | |
| Sub total | 100.0 | 1901 | 80 | 1521 |
| Size Spray | | | | |
| LACFEN420 phenolic resin | 22.5 | | | |
| Triethanolamine 85 | 2.0 | | | |
| BUTOFAN LN240S latex | 55.0 | | | |
| Dye-Marrone permasol MU | 1.0 | | | |
| water | 19.4 | | | |
| Sub total | 100.0 | 177 | 45 | 79 |
| Total | | 3316 | | 2468 |

6.2. Size spray—Study: Effects of the latex/resin ratio of the size on the product performance:

A second set of experiments have been made to establish what are the effect of the dry ratio latex/resin in the size spray step on the product performance. Experimental products are described as following:

Example 6 is a full latex NBR sprayed size

Example 7 is a size made with a dry ration of 80 of latex and 20 of resin

Example 8 is a size made with a dry ration of 60 of latex and 40 of resin

Example 9 is a size made with a dry ration of 40 of latex and 60 of resin

Example 10 is a size made with a dry ration of 20 of latex and 80 of resin

Example 11 is a full phenolic resin sprayed size.

Formulations in details are described herein after.

Performance tests of the products with different ratios latex/resin have been carried out as follows:

Flexibility has been studied with sensitive "hand" evaluation. "Cut" and "wear" have been studied with the method previously described. Finish level and "smear resistance" have been studied with the method previously described.

Figure 4:
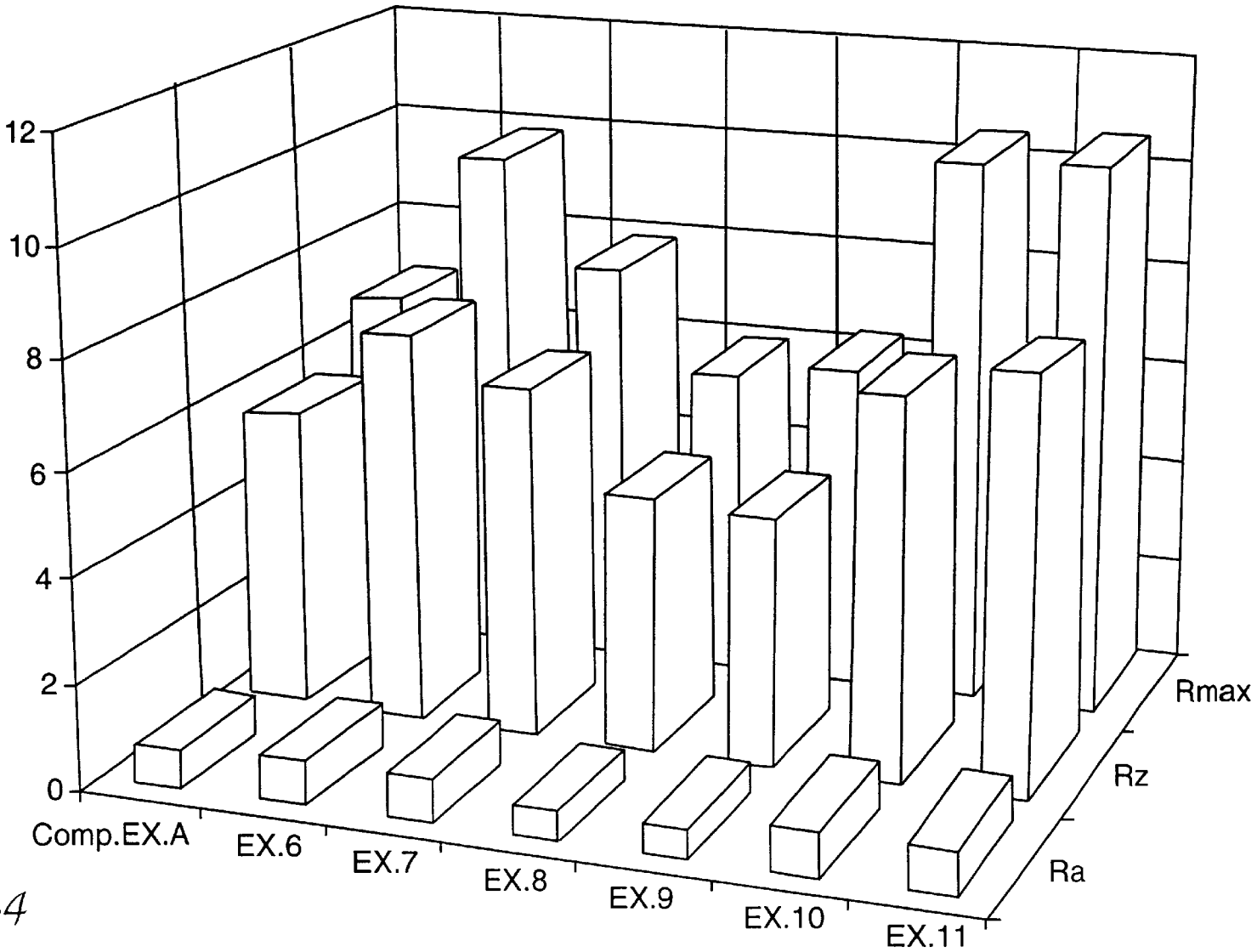
FIG. 4 represents the results of roughness measurements versus latex/resin dry ratio of the size binder at the "size" level of the example products.
Figure 5:
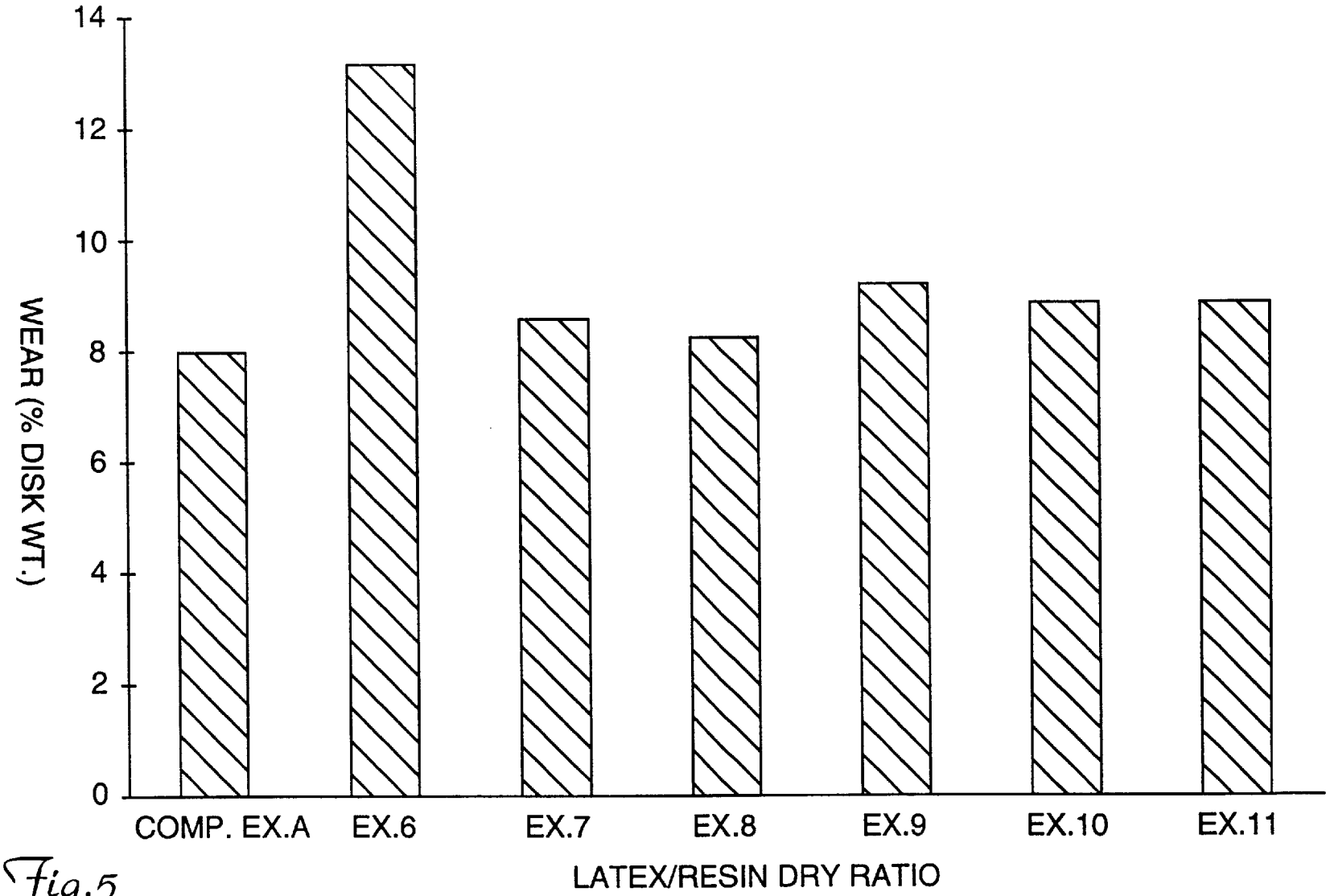
FIG. 5 represents the results of the effect on disc "wear" versus the dry ratio latex/resin at the "size" level of the example products.
Figure 6:
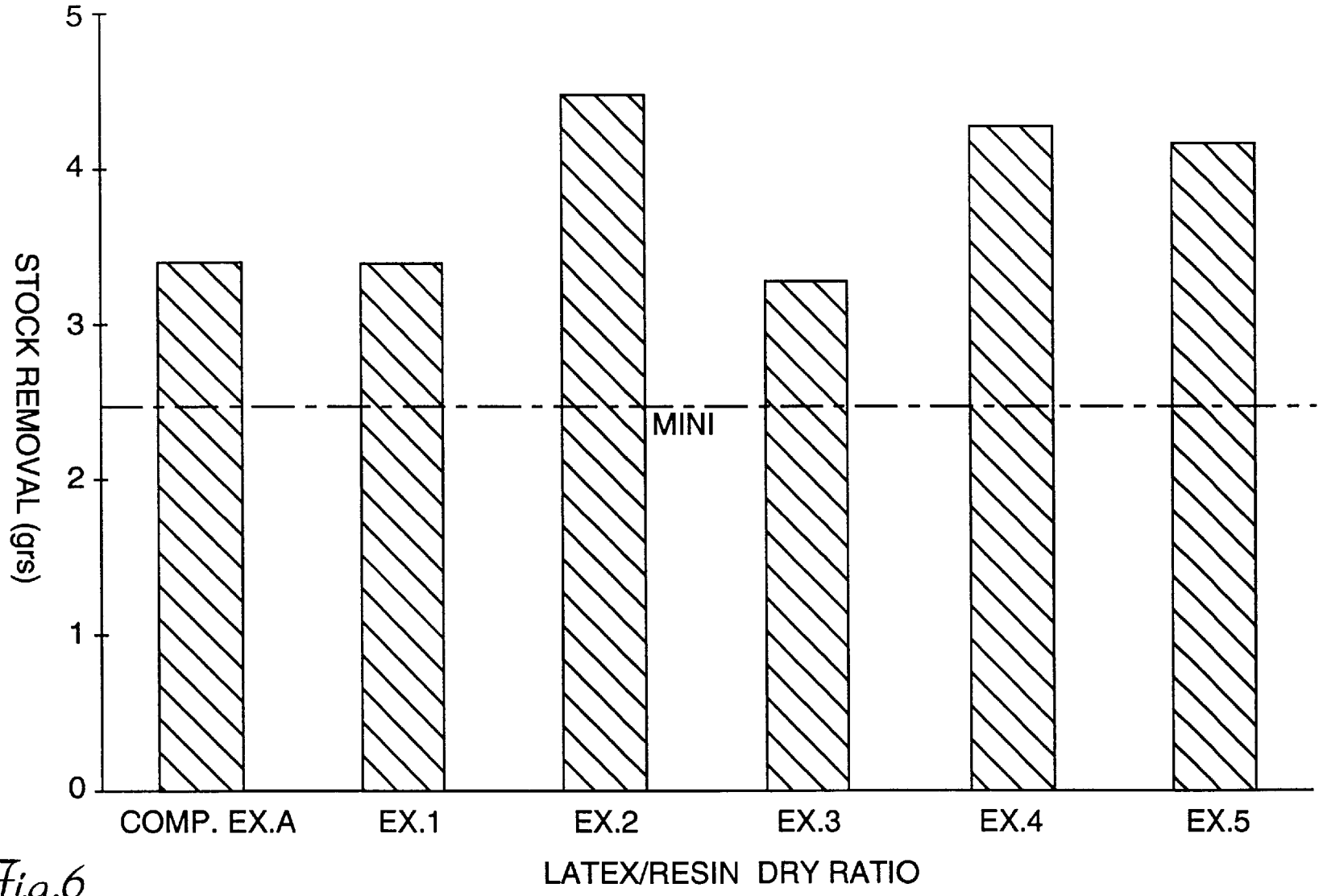
FIG. 6 represents the effect on "cut" versus the dry ratio latex/resin at the "size" level of the example products.

The results are reported in the FIGS. 4 to 6.

Products made with 60/40 and 40/60 latex/resin size sprays are showing the best wear resistance results. Products made with 60/40 and 40/60 latex/resin size sprays are showing the lowest roughness values so achieve the best finish results. "Cut" tendency is to increase with the amount of phenolic resin in the size mix. Flexibility is not affected by size ratio modifications. None of the products are showing "smearing".

In conclusion, products made with size dry ratio latex/resin from 60/40 to 40/60 are showing the best performances compromise.

Example 6

Experimental Product

Dry Ratios: Prebond: 90/10 latex/resin Size: 100 latex

| DESIGNATION | RM Qty % | Wet Qty Gr/SQM | % solids | Dry qty Gr/SQM |
|---|---|---|---|---|
| Fiber web | | | | |
| Nylon scrim | | | | 150 |
| 60 denier nylon fiber | | | | 300 |
| Sub total | | | | 450 |
| Prebond Roll Coat | | | | |
| LACFEN420 phenolic resin | 6.7 | | | |
| Triethanolamine 85 | 0.3 | | | |
| PERBUNAN N 2890 latex | 88.0 | | | |
| CARBOSOL CMC | 4.1 | | | |
| Dye-Marrone permasol MU | 0.9 | | | |
| Sub total | 100.0 | 961 | 42 | 404 |
| Slurry Spray | | | | |
| water | 7.0 | | | |
| CARBOSOL CMC | 2.0 | | | |
| 80 grit A1203 | 33.6 | | | |
| 100 grit A1203 | 16.8 | | | |
| LACFEN415 phenolic resin | 20.2 | | | |
| POLICRIL 307R acrylic resin | 10.9 | | | |
| Melamine in powder | 1.2 | | | |
| Calcium carbonate | 7.4 | | | |
| Dye-Marrone permasol MU | 0.9 | | | |
| Sub total | 100.0 | 1901 | 80 | 1521 |
| Size Spray | | | | |
| BUTOFAN LN240S latex | 100.0 | | | |
| Sub total | 100.0 | 170 | 41 | 70 |
| Total | | 3482 | | 2444 |

Example 7

Experimental Product

Dry Ratios: Prebond: 90/10 latex/resin Size: 80/20 latex/resin

| DESIGNATION | RM Qty % | Wet Qty Gr/SQM | % solids | Dry qty Gr/SQM |
|---|---|---|---|---|
| Fiber web | | | | |
| Nylon scrim | | | | 150 |
| 60 denier nylon fiber | | | | 300 |
| Sub total | | | | 450 |
| Prebond Roll Coat | | | | |
| LACFEN420 phenolic resin | 6.7 | | | |
| Triethanolamine 85 | 0.3 | | | |
| PERBUNAN N 2890 latex | 88.0 | | | |
| CARBOSOL CMC | 4.1 | | | |
| Dye-Marrone permasol MU | 0.9 | | | |
| Sub total | 100.0 | 961 | 42 | 404 |
| Slurry Spray | | | | |
| water | 7.0 | | | |
| CARBOSOL CMC | 2.0 | | | |
| 80 grit A1203 | 33.6 | | | |
| 100 grit A1203 | 16.8 | | | |
| LACFEN415 phenolic resin | 20.2 | | | |
| POLICRIL 307R acrylic resin | 10.9 | | | |
| Melamine in powder | 1.2 | | | |
| Calcium carbonate | 7.4 | | | |
| Dye-Marrone permasol MU | 0.9 | | | |
| Sub total | 100.0 | 1901 | 80 | 1521 |
| Size Spray | | | | |
| LACFEN420 phenolic resin | 13.5 | | | |
| Triethanolamine 85 | 1.2 | | | |
| BUTOFAN LN240S latex | 85.3 | | | |
| Sub total | 100.0 | 163 | 43 | 70 |
| Total | | 3475 | | 2445 |

Example 8

Experimental Product

Dry Ratios: Prebond: 90/10 latex/resin Size: 60/40 latex/resin

| DESIGNATION | RM Qty % | Wet Qty Gr/SQM | % solids | Dry qty Gr/SQM |
|---|---|---|---|---|
| Fiber web | | | | |
| Nylon scrim | | | | 150 |
| 60 denier nylon fiber | | | | 300 |
| Sub total | | | | 450 |
| Prebond Roll Coat | | | | |
| LACFEN420 phenolic resin | 6.7 | | | |
| Triethanolamine 85 | 0.3 | | | |
| PERBUNAN N 2890 latex | 88.0 | | | |
| CARBOSOL CMC | 4.1 | | | |
| Dye-Marrone permasol MU | 0.9 | | | |
| Sub total | 100.0 | 961 | 42 | 404 |
| Slurry Spray | | | | |
| water | 7.0 | | | |
| CARBOSOL CMC | 2.0 | | | |
| 80 grit A1203 | 33.6 | | | |
| 100 grit A1203 | 16.8 | | | |
| LACFEN415 phenolic resin | 20.2 | | | |
| POLICRIL 307R acrylic resin | 10.9 | | | |
| Melamine in powder | 1.2 | | | |
| Calcium carbonate | 7.4 | | | |
| Dye-Marrone permasol MU | 0.9 | | | |
| Sub total | 100.0 | 1901 | 80 | 1521 |
| Size Spray | | | | |
| LACFEN420 phenolic resin | 29.0 | | | |
| Triethanolamine 85 | 3.2 | | | |

-continued

| DESIGNATION | RM Qty % | Wet Qty Gr/SQM | % solids | Dry qty Gr/SQM |
|---|---|---|---|---|
| BUTOFAN LN240S latex | 67.7 | | | |
| Sub total | 100.0 | 155 | 45 | 70 |
| Total | | 3467 | | 2444 |

Example 9

Experimental Product

Dry Ratios: Prebond: 90/10 latex/resin Size: 40/60 latex/resin

| DESIGNATION | RM Qty % | Wet Qty Gr/SQM | % solids | Dry qty Gr/SQM |
|---|---|---|---|---|
| Fiber web | | | | |
| Nylon scrim | | | | 150 |
| 60 denier nylon fiber | | | | 300 |
| Sub total | | | | 450 |
| Prebond Roll Coat | | | | |
| LACFEN420 phenolic resin | 6.7 | | | |
| Triethanolamine 85 | 0.3 | | | |
| PERBUNAN N 2890 latex | 88.0 | | | |
| CARBOSOL CMC | 4.1 | | | |
| Dye-Marrone permasol MU | 0.9 | | | |
| Sub total | 100.0 | 961 | 42 | 404 |
| Slurry Spray | | | | |
| water | 7.0 | | | |
| CARBOSOL CMC | 2.0 | | | |
| 80 grit A1203 | 33.6 | | | |
| 100 grit A1203 | 16.8 | | | |
| LACFEN415 phenolic resin | 20.2 | | | |
| POLICRIL 307R acrylic resin | 10.9 | | | |
| Melamine in powder | 1.2 | | | |
| Calcium carbonate | 7.4 | | | |
| Dye-Marrone permasol MU | 0.9 | | | |
| Sub total | 100.0 | 1901 | 80 | 1521 |
| Size Spray | | | | |
| LACFEN420 phenolic resin | 47.9 | | | |
| Triethanolamine 85 | 4.1 | | | |
| BUTOFAN LN240S latex | 47.9 | | | |
| Sub total | 100.0 | 146 | 48 | 70 |
| Total | | 3458 | | 2445 |

Example 10

Experimental Product

Dry Ratios: Prebond: 90/10 latex/resin Size: 20/80 latex/resin

| DESIGNATION | RM Qty % | Wet Qty Gr/SQM | % solids | Dry qty Gr/SQM |
|---|---|---|---|---|
| Fiber web | | | | |
| Nylon scrim | | | | 150 |
| 60 denier nylon fiber | | | | 300 |
| Sub total | | | | 450 |
| Prebond Roll Coat | | | | |
| LACFEN420 phenolic resin | 6.7 | | | |
| Triethanolamine 85 | 0.3 | | | |
| PERBUNAN N 2890 latex | 88.0 | | | |
| CARBOSOL CMC | 4.1 | | | |
| Dye-Marrone permasol MU | 0.9 | | | |
| Sub total | 100.0 | 961 | 42 | 404 |
| Slurry Spray | | | | |
| water | 7.0 | | | |
| CARBOSOL CMC | 2.0 | | | |
| 80 grit A1203 | 33.6 | | | |
| 100 grit A1203 | 16.8 | | | |
| LACFEN415 phenolic resin | 20.2 | | | |
| POLICRIL 307R acrylic resin | 10.9 | | | |
| Melamine in powder | 1.2 | | | |
| Calcium carbonate | 7.4 | | | |
| Dye-Marrone permasol MU | 0.9 | | | |
| Sub total | 100.0 | 1901 | 80 | 1521 |
| Size Spray | | | | |
| LACFEN420 phenolic resin | 68.9 | | | |
| Triethanolamine 85 | 5.2 | | | |
| BUTOFAN LN240S latex | 25.9 | | | |
| Sub total | 100.0 | 135 | 52 | 70 |
| Total | | 3447 | | 2445 |

Example 11

Experimental Product

Dry Ratios: Prebond: 90/10 latex/resin Size: 100 resin

| DESIGNATION | RM Qty % | Wet Qty Gr/SQM | % solids | Dry qty Gr/SQM |
|---|---|---|---|---|
| Fiber web | | | | |
| Nylon scrim | | | | 150 |
| 60 denier nylon fiber | | | | 300 |
| Sub total | | | | 450 |
| Prebond Roll Coat | | | | |
| LACFEN420 phenolic resin | 6.7 | | | |
| Triethanolamine 85 | 0.3 | | | |
| PERBUNAN N 2890 latex | 88.0 | | | |
| CARBOSOL CMC | 4.1 | | | |
| Dye-Marrone permasol MU | 0.9 | | | |
| Sub total | 100.0 | 961 | 42 | 404 |
| Slurry Spray | | | | |
| water | 7.0 | | | |
| CARBOSOL CMC | 2.0 | | | |
| 80 grit A1203 | 33.6 | | | |
| 100 grit A1203 | 16.8 | | | |
| LACFEN415 phenolic resin | 20.2 | | | |
| POLICRIL 307R acrylic resin | 10.9 | | | |

-continued

| DESIGNATION | RM Qty % | Wet Qty Gr/SQM | % solids | Dry qty Gr/SQM |
|---|---|---|---|---|
| Melamine in powder | 1.2 | | | |
| Calcium carbonate | 7.4 | | | |
| Dye-Marrone permasol MU | 0.9 | | | |
| Sub total | 100.0 | 1901 | 80 | 1521 |
| Size Spray | | | | |
| LACFEN420 phenolic resin | 100.0 | | | |
| Sub total | 100.0 | 113 | 62 | 70 |
| Total | | 3425 | | 2444 |

6.3. At the "size" level: Other experiments have been made. Experimental product references are described as following, the dry ratio latex versus resin of the prebond being "70/30" instead of "90/10".

Example 12 is a full latex NBR sprayed size.

Example 13 is a size made with a dry ratio of 60 of latex and 40 of resin.

Example 14 is a size made with a dry ratio of 30 of latex arid 70 of resin.

Formulations in details are described hereinafter.

The performance tests have confirmed the results indicated in 6.2.

Example 12

Experimental Product

Dry Ratios: Prebond: 70/30 latex/resin Size: 100 latex

| DESIGNATION | RM Qty % | Wet Qty Gr/SQM | % solids | Dry qty Gr/SQM |
|---|---|---|---|---|
| Fiber web | | | | |
| Nylon scrim | | | | 150 |
| 60 denier nylon fiber | | | | 300 |
| Sub total | | | | 450 |
| Prebond Roll Coat | | | | |
| LACFEN420 phenolic resin | 20.7 | | | |
| Triethanolamine 85 | 0.9 | | | |
| PERBUNAN N 2890 latex | 73.3 | | | |
| CARBOSOL CMC | 4.1 | | | |
| Dye-Marrone permasol MU | 0.9 | | | |
| Sub total | 100.0 | 955 | 44 | 420 |
| Slurry Spray | | | | |
| water | 7.0 | | | |
| CARBOSOL CMC | 2.0 | | | |
| 80 grit A1203 | 33.6 | | | |
| 100 grit A1203 | 16.8 | | | |
| LACFEN415 phenolic resin | 20.2 | | | |
| POLICRIL 307R acrylic resin | 10.9 | | | |
| Melamine in powder | 1.2 | | | |
| Calcium carbonate | 7.4 | | | |
| Dye-Marrone permasol MU | 0.9 | | | |
| Sub total | 100.0 | 1901 | 80 | 1521 |
| Size Spray | | | | |
| BUTOFAN LN240S latex | 98.8 | | | |
| Dye-Marrone permasol MU | 1.2 | | | |

-continued

| DESIGNATION | RM Qty % | Wet Qty Gr/SQM | % solids | Dry qty Gr/SQM |
|---|---|---|---|---|
| Sub total | 100.0 | 170 | 41 | 70 |
| Total | | 3476 | | 2461 |

Example 13

Experimental Product

Dry Ratios: Prebond: 70/30 latex/resin Size: 60/40 latex/resin

| DESIGNATION | RM Qty % | Wet Qty Gr/SQM | % solids | Dry qty Gr/SQM |
|---|---|---|---|---|
| Fiber web | | | | |
| Nylon scrim | | | | 150 |
| 60 denier nylon fiber | | | | 300 |
| Sub total | | | | 450 |
| Prebond Roll Coat | | | | |
| LACFEN420 phenolic resin | 20.7 | | | |
| Triethanolamine 85 | 0.9 | | | |
| PERBUNAN N 2890 latex | 73.3 | | | |
| CARBOSOL CMC | 4.1 | | | |
| Dye-Marrone permasol MU | 0.9 | | | |
| Sub total | 100.0 | 955 | 44 | 420 |
| Slurry Spray | | | | |
| water | 7.0 | | | |
| CARBOSOL CMC | 2.0 | | | |
| 80 grit A1203 | 33.6 | | | |
| 100 grit A1203 | 16.8 | | | |
| LACFEN415 phenolic resin | 20.2 | | | |
| POLICRIL 307R acrylic resin | 10.9 | | | |
| Melamine in powder | 1.2 | | | |
| Calcium carbonate | 7.4 | | | |
| Dye-Marrone permasol MU | 0.9 | | | |
| Sub total | 100.0 | 1901 | 80 | 1521 |
| Size Spray | | | | |
| LACFEN420 phenolic resin | 28.0 | | | |
| Triethanolamine 85 | 2.8 | | | |
| BUTOFAN LN240S latex | 67.8 | | | |
| Dye-Marrone permasol MU | 1.4 | | | |
| Sub total | 100.0 | 143 | 45 | 64 |
| Total | | 3449 | | 2455 |

Example 14

Experimental Product

Dry Ratios: Prebond: 70/30 latex/resin Size: 30/70 latex/resin

| DESIGNATION | RM Qty % | Wet Qty Gr/SQM | % solids | Dry qty Gr/SQM |
|---|---|---|---|---|
| Fiber web | | | | |
| Nylon scrim | | | | 150 |

-continued

| DESIGNATION | RM Qty % | Wet Qty Gr/SQM | % solids | Dry qty Gr/SQM |
|---|---|---|---|---|
| 60 denier nylon fiber | | | | 300 |
| Sub total | | | | 450 |
| Prebond Roll Coat | | | | |
| LACFEN420 phenolic resin | 20.7 | | | |
| Triethanolamine 85 | 0.9 | | | |
| PERBUNAN N 2890 latex | 73.3 | | | |
| CARBOSOL CMC | 4.1 | | | |
| Dye-Marrone permasol MU | 0.9 | | | |
| Sub total | 100.0 | 955 | 44 | 420 |
| Slurry Spray | | | | |
| water | 7.0 | | | |
| CARBOSOL CMC | 2.0 | | | |
| 80 grit A1203 | 33.6 | | | |
| 100 grit A1203 | 16.8 | | | |
| LACFEN415 phenolic resin | 20.2 | | | |
| POLICRIL 307R acrylic resin | 10.9 | | | |
| Melamine in powder | 1.2 | | | |
| Calcium carbonate | 7.4 | | | |
| Dye-Marrone permasol MU | 0.9 | | | |
| Sub total | 100.0 | 1901 | 80 | 1521 |
| Size Spray | | | | |
| LACFEN420 phenolic resin | 59.0 | | | |
| Triethanolamine 85 | 2.8 | | | |
| BUTOFAN LN240S latex | 36.8 | | | |
| Dye-Marrone permasol MU | 1.4 | | | |
| Sub total | 100.0 | 144 | 52 | 75 |
| Total | | 3450 | | 2466 |

6.4. Another set of examples has been made with various fiber web compositions.

Formulation details are described hereinafter. The performance tests show the results presented in tables 1 to 4.

Example 15

Experimental Product

Dry Ratio: Prebond: 90/10 latex/resin

| DESIGNATION | RM Qty % | Wet Qty Gr/SQM | % solids | Dry qty Gr/SQM |
|---|---|---|---|---|
| Fiber web | | | | |
| Nylon scrim | | | | 150 |
| 60 denier nylon fiber | | | | 300 |
| Sub total | | | | 450 |
| Prebond Roll Coat | | | | |
| water | 11.4 | | | |
| LACFEN420 phenolic resin | 5.6 | | | |
| POLICRIL A/D thickener | 3.0 | | | |
| Triethanolamine 85 | 1.5 | | | |
| PERBUNAN N 2890 latex | 73.0 | | | |
| Technical urea | 2.5 | | | |
| Cellofix M50 liquid melamine | 1.5 | | | |
| Dye-Marrone permasol MU | 1.5 | | | |
| Sub total | 100.0 | 654.65 | 65 | 426 |
| Slurry Spray | | | | |
| water | 7.0 | | | |
| CARBOSOL CMC | 2.0 | | | |
| 80 grit A1203 | 33.6 | | | |
| 100 grit A1203 | 16.8 | | | |
| LACFEN415 phenolic resin | 20.2 | | | |
| POLICRIL 307R acrylic resin | 10.9 | | | |
| Melamine in powder | 1.2 | | | |
| Calcium carbonate | 7.4 | | | |
| Dye-Marrone permasol MU | 0.9 | | | |
| Sub total | 100.0 | 1901 | 80 | 1521 |
| Size Spray | | | | |
| water | 18.6 | | | |
| LACFEN420 phenolic resin | 21.7 | | | |
| PERBUNAN N2890 latex | 52.9 | | | |
| Melamine in powder | 3.9 | | | |
| Triethanolamine 85 | 1.0 | | | |
| Dye-Marrone permasol MU | 2.0 | | | |
| Sub total | 100.0 | 183.8 | 42 | 77 |
| Total | | 3189 | | 2474 |

Example 16

Experimental Product

Dry Ratio: Prebond: 90/10 latex/resin

| DESIGNATION | RM Qty % | Wet Qty Gr/SQM | % solids | Dry qty Gr/SQM |
|---|---|---|---|---|
| Fiber web | | | | |
| Nylon scrim | | | | 150 |
| 60 denier nylon fiber | | | | 300 |
| Sub total | | | | 450 |
| Prebond Roll Coat | | | | |
| water | 11.4 | | | |
| POLICRIL A/D thickener | 3.0 | | | |
| Triethanolamine 85 | 1.5 | | | |
| PERBUNAN N 2890 latex | 73.0 | | | |
| Technical urea | 2.5 | | | |
| Cellofix M50 liquid melamine | 1.5 | | | |
| Dye-Marrone permasol MU | 1.5 | | | |
| Sub total | 100.0 | 654.65 | 65 | 426 |
| Slurry Spray | | | | |
| water | 7.0 | | | |
| CARBOSOL CMC | 2.0 | | | |
| 80 grit A1203 | 33.6 | | | |
| 100 grit A1203 | 16.8 | | | |
| LACFEN415 phenolic resin | 20.2 | | | |
| POLICRIL 307R acrylic resin | 10.9 | | | |
| Melamine in powder | 1.2 | | | |
| Calcium carbonate | 7.4 | | | |
| Dye-Marrone permasol MU | 0.9 | | | |
| Sub total | 100.0 | 1901 | 80 | 1521 |
| Size Spray | | | | |
| water | 18.6 | | | |
| LACFEN420 phenolic resin | 21.7 | | | |
| PERBUNAN N2890 latex | 52.9 | | | |
| Melamine in powder | 3.9 | | | |
| Triethanolamine 85 | 1.0 | | | |

-continued

| DESIGNATION | RM Qty % | Wet Qty Gr/SQM | % solids | Dry qty Gr/SQM |
|---|---|---|---|---|
| Dye-Marrone permasol MU | 2.0 | | | |
| Sub total | 100.0 | 183.8 | 42 | 77 |
| Total | | 3189 | | 2474 |

Example 17

Experimental Product

Dry Ratio: Prebond: 90/10 latex/resin

| DESIGNATION | RM Qty % | Wet Qty Gr/SQM | % solids | Dry qty Gr/SQM |
|---|---|---|---|---|
| Fiber web | | | | |
| Polyester (PET) scrim | | | | 250 |
| 100 denier nylon fiber | | | | 300 |
| Sub total | | | | 550 |
| Prebond Roll Coat | | | | |
| water | 11.4 | | | |
| LACFEN420 phenolic resin | 5.6 | | | |
| POLICRIL A/D thickener | 3.0 | | | |
| Triethanolamine 85 | 1.5 | | | |
| PERBUNAN N 2890 latex | 73.0 | | | |
| Technical urea | 2.5 | | | |
| Cellofix M50 liquid melamine | 1.5 | | | |
| Dye-Marrone permasol MU | 1.5 | | | |
| Sub total | 100.0 | 654.65 | 65 | 426 |
| Slurry Spray | | | | |
| water | 7.0 | | | |
| CARBOSOL CMC | 2.0 | | | |
| 80 grit A1203 | 33.6 | | | |
| 100 grit A1203 | 16.8 | | | |
| LACFEN415 phenolic resin | 20.2 | | | |
| POLICRIL 307R acrylic resin | 10.9 | | | |
| Melamine in powder | 1.2 | | | |
| Calcium carbonate | 7.4 | | | |
| Dye-Marrone permasol MU | 0.9 | | | |
| Sub total | 100.0 | 1901 | 80 | 1521 |
| Size Spray | | | | |
| water | 18.6 | | | |
| LACFEN420 phenolic resin | 21.7 | | | |
| PERBUNAN N2890 latex | 52.9 | | | |
| Melamine in powder | 3.9 | | | |
| Triethanolamine 85 | 1.0 | | | |
| Dye-Marrone permasol MU | 2.0 | | | |
| Sub total | 100.0 | 183.8 | 42 | 77 |
| Total | | 3289 | | 2574 |

Example 18

Experimental Product

Dry Ratio: Prebond: 90/10 latex/resin

| DESIGNATION | RM Qty % | Wet Qty Gr/SQM | % solids | Dry qty Gr/SQM |
|---|---|---|---|---|
| Fiber web | | | | |
| Polyester (PET) scrim | | | | 250 |
| 60 denier nylon fiber | | | | 300 |
| Sub total | | | | 550 |
| Prebond Roll Coat | | | | |
| water | 11.4 | | | |
| LACFEN420 phenolic resin | 5.6 | | | |
| POLICRIL A/D thickener | 3.0 | | | |
| Triethanolamine 85 | 1.5 | | | |
| PERBUNAN N 2890 latex | 73.0 | | | |
| Technical urea | 2.5 | | | |
| Cellofix M50 liquid melamine | 1.5 | | | |
| Dye-Marrone permasol MU | 1.5 | | | |
| Sub total | 100.0 | 654.65 | 65 | 426 |
| Slurry Spray | | | | |
| water | 7.0 | | | |
| CARBOSOL CMC | 2.0 | | | |
| 80 grit A1203 | 33.6 | | | |
| 100 grit A1203 | 16.8 | | | |
| LACFEN415 phenolic resin | 20.2 | | | |
| POLICRIL 307R acrylic resin | 10.9 | | | |
| Melamine in powder | 1.2 | | | |
| Calcium carbonate | 7.4 | | | |
| Dye-Marrone permasol MU | 0.9 | | | |
| Sub total | 100.0 | 1901 | 80 | 1521 |
| Size Spray | | | | |
| water | 18.6 | | | |
| LACFEN420 phenolic resin | 21.7 | | | |
| PERBUNAN N2890 latex | 52.9 | | | |
| Melamine in powder | 3.9 | | | |
| Triethanolamine 85 | 1.0 | | | |
| Dye-Marrone permasol MU | 2.0 | | | |
| Sub total | 100.0 | 183.8 | 42 | 77 |
| Total | | 3289 | | 2574 |

Example 19

Experimental Product

Dry Ratio: Prebond: 70/30 latex/resin

| DESIGNATION | RM Qty % | Wet Qty Gr/SQM | % solids | Dry qty Gr/SQM |
|---|---|---|---|---|
| Fiber web | | | | |
| Polyester (PET) scrim | | | | 250 |
| 100 denier nylon fiber | | | | 300 |
| Sub total | | | | 550 |
| Prebond Roll Coat | | | | |
| water | 11.4 | | | |
| LACFEN420 phenolic resin | 17.5 | | | |
| POLICRIL A/D thickener | 3.0 | | | |
| Triethanolamine 85 | 1.5 | | | |
| PERBUNAN N 2890 latex | 61.1 | | | |
| Technical urea | 2.5 | | | |

-continued

| DESIGNATION | RM Qty % | Wet Qty Gr/SQM | % solids | Dry qty Gr/SQM |
|---|---|---|---|---|
| Cellofix M50 liquid melamine | 1.5 | | | |
| Dye-Marrone permasol MU | 1.5 | | | |
| Sub total | 100.0 | 654.6 | 67 | 439 |
| Slurry Spray | | | | |
| water | 7.0 | | | |
| CARBOSOL CMC | 2.0 | | | |
| 80 grit A1203 | 33.6 | | | |
| 100 grit A1203 | 16.8 | | | |
| LACFEN415 phenolic resin | 20.2 | | | |
| POLICRIL 307R acrylic resin | 10.9 | | | |
| Melamine in powder | 1.2 | | | |
| Calcium carbonate | 7.4 | | | |
| Dye-Marrone permasol MU | 0.9 | | | |
| Sub total | 100.0 | 1901 | 80 | 1521 |
| Size Spray | | | | |
| water | 18.6 | | | |
| LACFEN420 phenolic resin | 21.7 | | | |
| PERBUNAN N2890 latex | 52.9 | | | |
| Melamine in powder | 3.9 | | | |
| Triethanolamine 85 | 1.0 | | | |
| Dye-Marrone permasol MU | 2.0 | | | |
| Sub total | 100.0 | 183.8 | 42 | 77 |
| Total | | 3289 | | 2587 |

Example 20

Experimental Product

Dry Ratio: Prebond: 70/30 latex/resin

| DESIGNATION | RM Qty % | Wet Qty Gr/SQM | % solids | Dry qty Gr/SQM |
|---|---|---|---|---|
| Fiber web | | | | |
| Nylon scrim | | | | 250 |
| 60 denier nylon fiber | | | | 300 |
| Sub total | | | | 550 |
| Prebond Roll Coat | | | | |
| water | 11.4 | | | |
| LACFEN420 phenolic resin | 17.5 | | | |
| POLICRIL A/D thickener | 3.0 | | | |
| Triethanolamine 85 | 1.5 | | | |
| PERBUNAN N 2890 latex | 61.1 | | | |
| Technical urea | 2.5 | | | |
| Cellofix M50 liquid melamine | 1.5 | | | |
| Dye-Marrone permasol MU | 1.5 | | | |
| Sub total | 100.0 | 654.6 | 67 | 439 |
| Slurry Spray | | | | |
| water | 7.0 | | | |
| CARBOSOL CMC | 2.0 | | | |
| 80 grit A1203 | 33.6 | | | |
| 100 grit A1203 | 16.8 | | | |
| LACFEN415 phenolic resin | 20.2 | | | |
| POLICRIL 307R acrylic resin | 10.9 | | | |
| Melamine in powder | 1.2 | | | |
| Calcium carbonate | 7.4 | | | |
| Dye-Marrone permasol MU | 0.9 | | | |
| Sub total | 100.0 | 1901 | 80 | 1521 |

-continued

| DESIGNATION | RM Qty % | Wet Qty Gr/SQM | % solids | Dry qty Gr/SQM |
|---|---|---|---|---|
| Size Spray | | | | |
| water | 18.6 | | | |
| LACFEN420 phenolic resin | 21.7 | | | |
| PERBUNAN N2890 latex | 52.9 | | | |
| Melamine in powder | 3.9 | | | |
| Triethanolamine 85 | 1.0 | | | |
| Dye-Marrone permasol MU | 2.0 | | | |
| Sub total | 100.0 | 183.8 | 42 | 77 |
| Total | | 3289 | | 2587 |

Example 21

Experimental Product

Dry Ratio: Prebond: 70/30 latex/resin

| DESIGNATION | RM Qty % | Wet Qty Gr/SQM | % solids | Dry qty Gr/SQM |
|---|---|---|---|---|
| Fiber web | | | | |
| Nylon scrim | | | | 150 |
| 70 denier nylon fiber | | | | 200 |
| 58 denier nylon fiber | | | | 86 |
| Sub total | | | | 436 |
| Prebond Roll Coat | | | | |
| water | 11.4 | | | |
| LACFEN420 phenolic resin | 17.5 | | | |
| POLICRIL A/D thickener | 3.0 | | | |
| Triethanolamine 85 | 1.5 | | | |
| PERBUNAN N 2890 latex | 61.1 | | | |
| Technical urea | 2.5 | | | |
| Cellofix M50 liquid melamine | 1.5 | | | |
| Dye-Marrone permasol MU | 1.5 | | | |
| Sub total | 100.0 | 654.6 | 67 | 439 |
| Slurry Spray | | | | |
| water | 7.0 | | | |
| CARBOSOL CMC | 2.0 | | | |
| 80 grit A1203 | 33.6 | | | |
| 100 grit A1203 | 16.8 | | | |
| LACFEN415 phenolic resin | 20.2 | | | |
| POLICRIL 307R acrylic resin | 10.9 | | | |
| Melamine in powder | 1.2 | | | |
| Calcium carbonate | 7.4 | | | |
| Dye-Marrone permasol MU | 0.9 | | | |
| Sub total | 100.0 | 1901 | 80 | 1521 |
| Size Spray | | | | |
| water | 18.6 | | | |
| LACFEN420 phenolic resin | 21.7 | | | |
| PERBUNAN N2890 latex | 52.9 | | | |
| Melamine in powder | 3.9 | | | |
| Triethanolamine 85 | 1.0 | | | |
| Dye-Marrone permasol MU | 2.0 | | | |
| Sub total | 100.0 | 183.8 | 42 | 77 |
| Total | | 3175 | | 2473 |

Example 22

Experimental Product

Dry Ratio: Prebond: urethane resin—reference

| DESIGNATION | RM Qty % | Wet Qty Gr/SQM | % solids | Dry qty Gr/SQM |
|---|---|---|---|---|
| Fiber web | | | | |
| Nylon scrim | | | | 150 |
| 70 denier nylon fiber | | | | 200 |
| 58 denier nylon fiber | | | | 86 |
| Sub total | | | | 436 |
| Prebond Roll Coat | | | | |
| BL 16 urethane resin | 62.3 | | | |
| MDA in PM Acetate solution | 19.2 | | | |
| PM Acetate | 13.7 | | | |
| Lithium stearate premix | 3.6 | | | |
| Brown pigment | 1.2 | | | |
| Sub total | 100.0 | 642 | 65 | 417 |
| Slurry Spray | | | | |
| water | 7.0 | | | |
| CARBOSOL CMC | 2.0 | | | |
| 80 grit A1203 | 33.6 | | | |
| 100 grit A1203 | 16.8 | | | |
| LACFEN415 phenolic resin | 20.2 | | | |
| POLICRIL 307R acrylic resin | 10.9 | | | |
| Melamine in powder | 1.2 | | | |
| Calcium carbonate | 7.4 | | | |
| Dye-Marrone permasol MU | 0.9 | | | |
| Sub total | 100.0 | 1901 | 80 | 1521 |
| Size Spray | | | | |
| water | 18.6 | | | |
| LACFEN420 phenolic resin | 21.7 | | | |
| PERBUNAN N2890 latex | 52.9 | | | |
| Melamine in powder | 3.9 | | | |
| Triethanolamine 85 | 1.0 | | | |
| Dye-Marrone permasol MU | 2.0 | | | |
| Sub total | 100.0 | 183.8 | 42 | 77 |
| Total | | 3163 | | 2451 |

Example 23

Experimental Product

Dry Ratio: Prebond: 70/30 latex/resin

| DESIGNATION | RM Qty % | Wet Qty Gr/SQM | % solids | Dry qty Gr/SQM |
|---|---|---|---|---|
| Fiber web | | | | |
| Polyester (PET) scrim | | | | 250 |
| 100 denier nylon fiber | | | | 300 |
| Sub total | | | | 550 |
| Prebond Roll Coat | | | | |
| water | 11.4 | | | |
| LACFEN420 phenolic resin | 17.5 | | | |
| POLICRIL A/D thickener | 3.0 | | | |
| Triethanolamine 85 | 1.5 | | | |
| PERBUNAN N 2890 latex | 61.1 | | | |
| Technical urea | 2.5 | | | |
| Cellofix M50 liquid melamine | 1.5 | | | |
| Dye-Marrone permasol MU | 1.5 | | | |
| Sub total | 100.0 | 654.6 | 67 | 439 |

-continued

| DESIGNATION | RM Qty % | Wet Qty Gr/SQM | % solids | Dry qty Gr/SQM |
|---|---|---|---|---|
| Slurry Spray | | | | |
| water | 7.0 | | | |
| CARBOSOL CMC | 2.0 | | | |
| 100 grit A1203 | 50.4 | | | |
| LACFEN415 phenolic resin | 20.2 | | | |
| POLICRIL 307R acrylic resin | 10.9 | | | |
| Melamine in powder | 1.2 | | | |
| Calcium carbonate | 7.4 | | | |
| Dye-Marrone permasol MU | 0.9 | | | |
| Sub total | 100.0 | 1901 | 80 | 1521 |
| Size Spray | | | | |
| water | 18.6 | | | |
| LACFEN420 phenolic resin | 21.7 | | | |
| PERBUNAN N2890 latex | 52.9 | | | |
| Melamine in powder | 3.9 | | | |
| Triethanolamine 85 | 1.0 | | | |
| Dye-Marrone permasol MU | 2.0 | | | |
| Sub total | 100.0 | 183.8 | 42 | 77 |
| Total | | 3289 | | 2587 |

Example 24

Experimental Product

Dry Ratio: Prebond: 70/30 latex/resin

| DESIGNATION | RM Qty % | Wet Qty Gr/SQM | % solids | Dry qty Gr/SQM |
|---|---|---|---|---|
| Fiber web | | | | |
| Nylon scrim | | | | 150 |
| 70 denier nylon fiber | | | | 200 |
| 58 denier nylon fiber | | | | 86 |
| Sub total | | | | 436 |
| Prebond Roll Coat | | | | |
| water | 11.4 | | | |
| LACFEN420 phenolic resin | 17.5 | | | |
| POLICRIL A/D thickener | 3.0 | | | |
| Triethanolamine 85 | 1.5 | | | |
| PERBUNAN N 2890 latex | 61.1 | | | |
| Technical urea | 2.5 | | | |
| Cellofix M50 liquid melamine | 1.5 | | | |
| Dye-Marrone permasol MU | 1.5 | | | |
| Sub total | 100.0 | 654.6 | 67 | 439 |
| Slurry Spray | | | | |
| water | 7.0 | | | |
| CARBOSOL CMC | 2.0 | | | |
| 100 grit A1203 | 50.4 | | | |
| LACFEN415 phenolic resin | 20.2 | | | |
| POLICRIL 307R acrylic resin | 10.9 | | | |
| Melamine in powder | 1.2 | | | |
| Calcium carbonate | 7.4 | | | |
| Dye-Marrone permasol MU | 0.9 | | | |
| Sub total | 100.0 | 1901 | 80 | 1521 |
| Size Spray | | | | |
| water | 18.6 | | | |
| LACFEN420 phenolic resin | 21.7 | | | |
| PERBUNAN N2890 latex | 52.9 | | | |

-continued

| DESIGNATION | RM Qty % | Wet Qty Gr/SQM | % solids | Dry qty Gr/SQM |
|---|---|---|---|---|
| Melamine in powder | 3.9 | | | |
| Triethanolamine 85 | 1.0 | | | |
| Dye-Marrone permasol MU | 2.0 | | | |
| Sub total | 100.0 | 183.8 | 42 | 77 |
| Total | | 3175 | | 2473 |

Example 25

Experimental Product

Dry Ratios: Prebond: urethane resin—reference

| DESIGNATION | RM Qty % | Wet Qty Gr/SQM | % solids | Dry qty Gr/SQM |
|---|---|---|---|---|
| Fiber web | | | | |
| Nylon scrim | | | | 150 |
| 70 denier nylon fiber | | | | 200 |
| 58 denier nylon fiber | | | | 86 |
| Sub total | | | | 436 |
| Prebond Roll Coat | | | | |
| BL 16 urethane resin | 62.3 | | | |
| MDA in PM Acetate solution | 19.2 | | | |
| PM Acetate | 13.7 | | | |
| Lithium stearate premix | 3.6 | | | |
| Brown pigment | 1.2 | | | |
| Sub total | 100.0 | 642 | 65 | 417 |
| Slurry Spray | | | | |
| water | 7.0 | | | |
| CARBOSOL CMC | 2.0 | | | |
| 100 grit A1203 | 50.4 | | | |
| LACFEN415 phenolic resin | 20.2 | | | |
| POLICRIL 307R acrylic resin | 10.9 | | | |
| Melamine in powder | 1.2 | | | |
| Calcium carbonate | 7.4 | | | |
| Dye-Marrone permasol MU | 0.9 | | | |
| Sub total | 100.0 | 1901 | 80 | 1521 |
| Size Spray | | | | |
| water | 18.6 | | | |
| LACFEN420 phenolic resin | 21.7 | | | |
| PERBUNAN N2890 latex | 52.9 | | | |
| Melamine in powder | 3.9 | | | |
| Triethanolamine 85 | 1.0 | | | |
| Dye-Marrone permasol MU | 2.0 | | | |
| Sub total | 100.0 | 183.8 | 42 | 77 |
| Total | | 3163 | | 2451 |

TABLE 1

Performance test: Smearing resistance

| IDENTIFICATION | SMEARING EVALUATION |
|---|---|
| Comparative Example A | No Smearing |
| Example 15 | No Smearing |
| Example 16 | No Smearing |
| Example 17 | No Smearing |

TABLE 1-continued

Performance test: Smearing resistance

| IDENTIFICATION | SMEARING EVALUATION |
|---|---|
| Example 18 | No Smearing |
| Example 19 | No Smearing |
| Example 20 | No Smearing |
| Example 21 | No Smearing |
| Example 22 | No Smearing |
| Example 23 | No Smearing |
| Example 24 | No Smearing |
| Example 25 | No Smearing |

TABLE 2

Performance test: Hand tool evaluation in disc form

| Product Identification | Edge Resistance Evaluation | Paint Removal Time | Loading Resistance Evaluation |
|---|---|---|---|
| Comparative | **** | 47 sec | ** |
| Example A | **** | 40 sec | ** |
| Example 20 | **** | 41 sec | ** |
| Example 21 | **** | 46 sec | ** |
| Example 22 | **** | 34 sec | ** |
| Example 23 | **** | 41 sec | ** |
| Example 24 | **** | 40 sec | ** |
| Example 25 | **** | 39 sec | ** |

Evaluation Scale: one star: bad behavior to five stars: excellent behavior

TABLE 3

Performance test: Cut & Wear in belt and disc forms

| | Belt tester | | | Disc tester | | |
|---|---|---|---|---|---|---|
| Products | Cut | Wear | Efficiency | Cut | Wear | Efficiency |
| Comparative Ex A | 239.9 | 41.6 | 5.8 | 3.88 | 5.23 | 0.74 |
| | 243.7 | 46.8 | 5.2 | | | |
| Example 15 | 229.9 | 38.9 | 5.9 | 3.73 | 4.43 | 0.84 |
| | 229.6 | 38.5 | 6.0 | | | |
| Example 16 | 229.9 | 36.2 | 6.4 | 3.68 | 3.68 | 1.00 |
| | 232.5 | 36.5 | 6.4 | | | |
| Example 17 | 198.2 | 26.1 | 7.6 | 3.85 | 3.45 | 1.12 |
| | 196.7 | 24.7 | 8.0 | | | |
| Example 18 | 221 | 41.5 | 5.3 | 3.63 | 3.93 | 0.92 |
| | 218.9 | 38.4 | 5.7 | | | |
| Example 19 | 247.6 | 34.2 | 7.2 | 4.43 | 4.18 | 1.06 |
| | 243.7 | 33.6 | 7.3 | | | |

TABLE 4

Performance test: Finish level on stainless steel

| | Roughness values ($\mu$m) | | |
|---|---|---|---|
| Products | Ra | Rz | Rmax |
| Comparative Ex A | 0.40 | 4.19 | 5.00 |
| Example 15 | 0.42 | 4.07 | 4.91 |
| Example 16 | 0.42 | 4.16 | 5.48 |
| Example 17 | 0.46 | 4.31 | 5.54 |
| Example 18 | 0.51 | 4.61 | 4.91 |
| Example 19 | 0.61 | 5.42 | 6.63 |

What is claimed is:

1. A surface conditioning article comprising an all organic matrix having adhered thereto water-base organic binders including a first binder and a second binder with abrasive particles dispersed and adhered within said second binder, wherein the first binder comprises a mixture of a phenolic resin and a carboxylated butadiene-acrylonitrile copolymer latex, in the range of weight ratio of dry materials of said latex versus said phenolic resin of 90/10 to 60/40, and wherein the article comprises a third binder coated over the second binder, said third binder comprising a mixture of phenolic resin and carboxylated butadiene acrylonirile copolymer latex.

2. A surface conditioning article according to claim 1, wherein said phenolic resin of the first binder is a resole phenolic resin with a water tolerance of at least 500% by weight.

3. A surface conditioning article according to claim 1, wherein said phenolic resin of the first binder has a molecular weight in the range of 100 to 1000.

4. A surface conditioning article according to claim 1, wherein said carboxylated butadiene-acrylonitrile latex, in the first binder, has a molar percent of acrylonitrile from 25% to 35%.

5. A surface conditioning article according to claim 1, wherein the latex comprises particles having a size in the range of 10 to 500 nm.

6. A surface conditioning article according to claim 1, wherein the weight ratio of dry materials of said latex versus said phenolic resin in the third binder is in the range of 60/40 to 40/60.

7. A surface conditioning article according to claim 6, wherein the phenolic resin and carboxylated butadiene-acrylonitrile latex are the same in the first and third binders.

8. A surface conditioning article according to claim 1, wherein the latex versus phenolic resin weight ratio is of 70/30 in the first binder and 60/40 in the third binder.

9. A surface conditioning article according to claim 1, wherein said organic matrix comprises an open, lofty, three-dimensional nonwoven web.

10. A surface conditioning article according to claim 9, wherein said nonwoven web comprises organic polyester or polyamid fibers.

11. A surface conditioning article according to claim 10, wherein the fibers have a denier from between 10 to 100 and a length from between 10 to 100 mm.

* * * * *

UNITED STATES PATENT AND TRADEMARK OFFICE

CERTIFICATE OF CORRECTION

PATENT NO. : 6,521,005 B1 
APPLICATION NO. : 10/193760
DATED : February 18, 2003
INVENTOR(S) : Bernard, Vincent It is certified that error appears in the above-identified patent and that said Letters Patent is hereby corrected as shown below:

Column 1
Line 36, delete “call” and insert in place thereof - - can - -.

Column 2
Line 45, delete “coates” and insert in place thereof - - coats - -.

Column 4
Line 14, delete “no” and insert in place thereof - - not - -.
Line 62, delete “catalyzing agent” and insert in place thereof - -catalyzing agents - -.

Column 8
Line 14, delete “form” and insert in place thereof - -from - -.
Line 61, after “example” insert - - of - -.

Column 9
Line 19, delete “times” and insert in place thereof - - timed - -.
Line 19, delete “minute” and insert in place there of - -minutes - -.

Column 10
Line 8, delete “bar” and insert in place thereof - - bars - -.
Line 28, delete “concerted” and insert in place thereof - -converted - -.

Signed and Sealed this

Twenty-ninth Day of August, 2006

JON W. DUDAS
*Director of the United States Patent and Trademark Office*